US009709929B2

(12) United States Patent
Izawa

(10) Patent No.: US 9,709,929 B2
(45) Date of Patent: Jul. 18, 2017

(54) FIXING DEVICE AND IMAGE FORMING APPARATUS INCLUDING THE SAME

(71) Applicant: Samsung Electronics Co., Ltd., Suwon-si (KR)

(72) Inventor: Tatsunori Izawa, Yokohama (JP)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/270,294

(22) Filed: Sep. 20, 2016

(65) Prior Publication Data

US 2017/0176898 A1 Jun. 22, 2017

(30) Foreign Application Priority Data

Dec. 16, 2015 (JP) ..... 2015-245390
Mar. 31, 2016 (KR) ..... 10-2016-0039620

(51) Int. Cl.
*G03G 15/20* (2006.01)

(52) U.S. Cl.
CPC ..... *G03G 15/2007* (2013.01); *G03G 15/2082* (2013.01)

(58) Field of Classification Search
CPC ..... G03G 15/2007; G03G 15/2082
See application file for complete search history.

(56) References Cited

U.S. PATENT DOCUMENTS 7,446,281 B2 * 11/2008 Kagawa ..... G03G 15/2064 219/216
8,351,807 B2 1/2013 Seki
8,532,552 B2 * 9/2013 Fujiwara ..... G03G 15/2053 399/328
9,146,508 B2 9/2015 Imada et al.
2011/0091229 A1 4/2011 Seol et al.
2012/0008971 A1 1/2012 Lee et al.
2014/0270872 A1 9/2014 Tamaki et al.

FOREIGN PATENT DOCUMENTS

| | | |
|---|---|---|
| JP | 2010-66583 | 3/2010 |
| JP | 2012-63463 | 3/2012 |
| JP | 2014-41172 | 3/2014 |
| JP | 2014-164223 | 9/2014 |
| JP | 2014-224839 | 12/2014 |
| KR | 10-2011-0041917 | 4/2011 |
| KR | 10-2014-0056665 | 5/2014 |

OTHER PUBLICATIONS

International Search Report and Written Opinion of the International Searching Authority dated Nov. 29, 2016 in International Patent Application No. PCT/KR2016/010396.

* cited by examiner

*Primary Examiner* — Hoang Ngo
(74) *Attorney, Agent, or Firm* — Staas & Halsey LLP

(57) ABSTRACT

A fixing device for improving heat efficiency and an image forming apparatus including the fixing device includes a heating roller, a pressing roller, a pressing portion, a halogen lamp, a reflection plate, a first reflection member including a first reflection unit configured to reflect light irradiated from a first halogen lamp to the heating rotator, and a second reflection member including a second reflection unit configured to reflect light irradiated from a second halogen lamp to the heating rotator, wherein a center portion of the first reflection unit has a higher reflectivity than opposite end portions of the first reflection unit, and opposite end portions of the second reflection unit have a higher reflectivity than a center portion of the second reflection unit.

20 Claims, 17 Drawing Sheets

(a)

(b)

(a)

(b)

FIXING DEVICE AND IMAGE FORMING APPARATUS INCLUDING THE SAME

CROSS-REFERENCE TO RELATED APPLICATIONS

This application claims the priority benefit of Japanese Patent Application No. 2015-245390, filed on Dec. 16, 2015, in the Japanese Patent Office and Korean Patent Application No. 10-2016-0039620, filed on Mar. 31, 2016, in the Korean Intellectual Property Office, the disclosures of which are incorporated herein in their entireties by reference.

BACKGROUND

1. Field

The following description relates to a fixing device and an image forming apparatus including the same.

2. Description of the Related Art

Conventional fixing devices, for example, a fixing device disclosed in Japanese Patent Publication Gazette No. 2010-66583, includes a fixing belt having a halogen lamp therein and a pressing roller arranged in pressure-contact to the fixing belt to form a nip portion between the pressing roller and the fixing belt. A non-fixed image may be formed on a recording medium such as paper passing through the nip portion, and the fixing device heats and presses the non-fixed image to fix the non-fixed image onto the recording medium.

Recently, there has been a demand for high productivity and high energy efficiency with respect to an image forming apparatus adopting a laser scheme. To improve productivity and energy efficiency, a low-heat-capacity fixing belt for improving heat efficiency may be arranged on a fixing device mounted on an image forming apparatus. For example, in the low-heat-capacity fixing belt, a halogen lamp for applying a certain amount of heat to the fixing belt may be arranged, and in this case, heat generated by light of the halogen lamp may be instantly transferred in a thickwise direction of the fixing belt, but may not be delivered in a widthwise direction of the recording medium, making it difficult to maintain a temperature in the widthwise direction of the recording medium constant. Thus, to adapt the halogen lamp to a different-width recording medium, a long halogen lamp corresponding to a wide-width recording medium may be used, and in this case, if a narrow-width recording medium is used, an unnecessary heating area may be generated in the fixing belt. That is, a problem may occur in efficiently heating the fixing belt to correspond to a different-width recording medium.

To solve these problems, the fixing device disclosed in Japanese Patent Publication Gazette No. 2010-66583 includes a shielding plate arranged between the halogen lamp and the fixing belt and an opening portion corresponding to the heated region of the fixing belt. In the fixing device disclosed in Japanese Patent Publication Gazette No. 2010-66583, the shielding plate moves along the widthwise direction of the recording medium and the size of the opening portion is adjusted, such that the width of the heated region included in the fixing belt may correspond to the different-width recording medium.

However, in the fixing device disclosed in Japanese Patent Publication Gazette No. 2010-66583, some of the heat generated by the light of the halogen lamp, i.e., heat applied to a portion blocked by the shielding plate, is not actually used, and thus, the fixing device may not be favorable in terms of heat efficiency.

SUMMARY

Provided are methods and apparatuses for a fixing device and an image forming apparatus including the same.

Additional aspects will be set forth in part in the description which follows and, in part, will be apparent from the description, or may be learned by practice of the presented embodiments.

According to an aspect of an embodiment, a fixing device configured to heat and press-contact a recording medium where a toner image is formed and to fix the toner image onto the recording medium includes a rotatable heating rotator, a pressing rotator configured to press-contact with the heating rotator and to form a nip portion between the pressing rotator and the heating rotator, a pressing portion configured to apply pressure to the heating rotator such that the heating rotator press-contacts with the pressing rotator, a first halogen lamp configured to extend along a rotation axis direction of the heating rotator and to heat the heating rotator, a second halogen lamp configured to extend along the rotation axis direction of the heating rotator in parallel with the first halogen lamp and to heat the heating rotator, a first reflection member configured to extend along a first axis direction of the first halogen lamp, and a second reflection member configured to extend along a second axis direction of the second halogen lamp, in which the first reflection member includes a first reflection unit configured to reflect light irradiated from the first halogen lamp to the heating rotator, and the second reflection member includes a second reflection unit configured to reflect light irradiated from the second halogen lamp to the heating rotator, and a center portion of the first reflection unit has a higher reflectivity than opposite end portions of the first reflection unit, and opposite end portions of the second reflection unit have a higher reflectivity than a center portion of the second reflection unit.

The first reflection member includes a first heat transfer unit configured to extend from the first reflection unit and to transfer heat generated by light, which is not reflected by the first reflection unit, from among the light irradiated from the first halogen lamp, to the heating rotator, and the second reflection member includes a second heat transfer unit configured to extend from the second reflection unit and to transfer heat generated by light, which is not reflected by the second reflection unit, from among the light irradiated from the second halogen lamp, to the heating rotator, and the first heat transfer unit and the second heat transfer unit are arranged in a non-contact manner.

A center-portion heating arrangement included in the first halogen lamp includes a first heated region that contributes to heating of a center portion of the heating rotator, and an end-portion heating arrangement included in the second halogen lamp includes a second heated region that contributes to heating of opposite end portions of the heating rotator.

The first heated region and the second heated region partially overlap with each other along the first axis direction and the second axis direction, and a boundary between the center portion and the opposite end portions included in the first reflection unit and a boundary between the center portion and the opposite end portions included in the second reflection unit are located in the partial overlapping region.

A first end-portion surface located in opposite end portions of the first reflection unit has a lower reflectivity than a first center-portion surface located in the center portion of the first reflection unit, and a second center-portion surface located in the center portion of the second reflection unit has a lower reflectivity than a second end-portion surface located in the opposite end portions of the second reflection unit.

The opposite end portions of the first reflection unit are cut away, and the center portion of the second reflection unit is cut away.

The first heat transfer unit includes a first contact portion contacting the heating rotator, the second heat transfer unit includes a second contact portion contacting the heating rotator, and the pressing unit pressingly contacts the heating rotator and the pressing rotator by applying pressure to the first contact unit and the second contact unit.

The first heat transfer unit and the second heat transfer unit are arranged in a non-contact manner.

The pressing unit contacts the heating rotator, and the first heat transfer unit and the second heat transfer unit transfer heat to the heating rotator using the pressing unit as a medium.

The opposite end portions of the first heat transfer unit are cut away, and the center portion of the second heat transfer unit is cut away.

The opposite end portions of the first contact unit are cut away, and the center portion of the second contact unit is cut away, and the first contact unit is arranged between the opposite end portions of the second contact unit arranged along the second axis direction.

The first heat transfer unit includes a first center heat transfer unit located in the center portion along the first axis direction and a first end heat transfer unit located in the opposite end portions along the first axis direction, and the first end heat transfer unit has a lower heat conductivity than the first center heat transfer unit, and the second heat transfer unit includes a second center heat transfer unit located in the center portion along the axis direction and a second end heat transfer unit located in the opposite end portions along the axis direction, and the second center heat transfer unit has a lower heat conductivity than the second end heat transfer unit.

A through-hole in a form of a slit shape is arranged in the first end heat transfer unit to extend along the first axis direction, and a through-hole in a form of a slit shape is arranged in the second center heat transfer unit to extend along the second axis direction.

The first end heat transfer unit is thinner than the first center heat transfer unit, and the second center heat transfer unit is thinner than the second end heat transfer unit.

According to an aspect of an embodiment, a fixing device configured to heat and pressingly contacts with a recording medium where a toner image is formed and to fix the toner image onto the recording medium includes a rotatable heating rotator, a pressing rotator configured to pressingly contacts with the heating rotator and to form a nip portion between the pressing rotator and the heating rotator, a pressing portion configured to apply pressure to the heating rotator such that the heating rotator pressingly contacts with the pressing rotator, a first halogen lamp configured to extend along a rotation axis direction of the heating rotator and to heat the heating rotator, a second halogen lamp configured to extend along the rotation axis direction of the heating rotator in parallel with the first halogen lamp and to heat the heating rotator, a first reflection member configured to extend along a first axis direction of the first halogen lamp, and a second reflection member configured to extend along a second axis direction of the second halogen lamp, in which the first reflection member includes a first reflection unit configured to reflect light irradiated from the first halogen lamp to the heating rotator, and the second reflection member includes a second reflection unit configured to reflect light irradiated from the second halogen lamp to the heating rotator, and a first light-shielding unit is arranged in the opposite end portions of the first reflection member to prevent light irradiated from the first halogen lamp from being reflected to the heating rotator, and a second light-shielding unit is arranged in the center portion of the second reflection member to prevent the light irradiated from the second halogen lamp from being reflected to the heating rotator.

A center-portion heating arrangement included in the first halogen lamp includes a first heated region that contributes to heating of the center portion of the heating rotator, and an end-portion heating arrangement included in the second halogen lamp includes a second heated region that contributes to heating of the opposite end portions of the heating rotator.

The first heated region and the second heated region partially overlap with each other along the first axis direction and the second axis direction, and an inner end portion of the first light-shielding unit and an outer end portion of the second light-shielding unit are located in the partial overlapping region.

The first light-shielding unit covers the heating rotator of the first halogen lamp, and the second light-shielding unit covers the heating rotator of the second halogen lamp.

A surface of the first light-shielding unit arranged to face the first halogen lamp has a lower reflectivity than a first center-portion surface located in the center portion of the first reflection unit, and a surface of the second light-shielding unit arranged to face the second halogen lamp has a lower reflectivity than a second end-portion surface located in the opposite end portions of the second reflection unit.

According to an aspect of an embodiment, an image forming apparatus includes the above-described fixing device.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
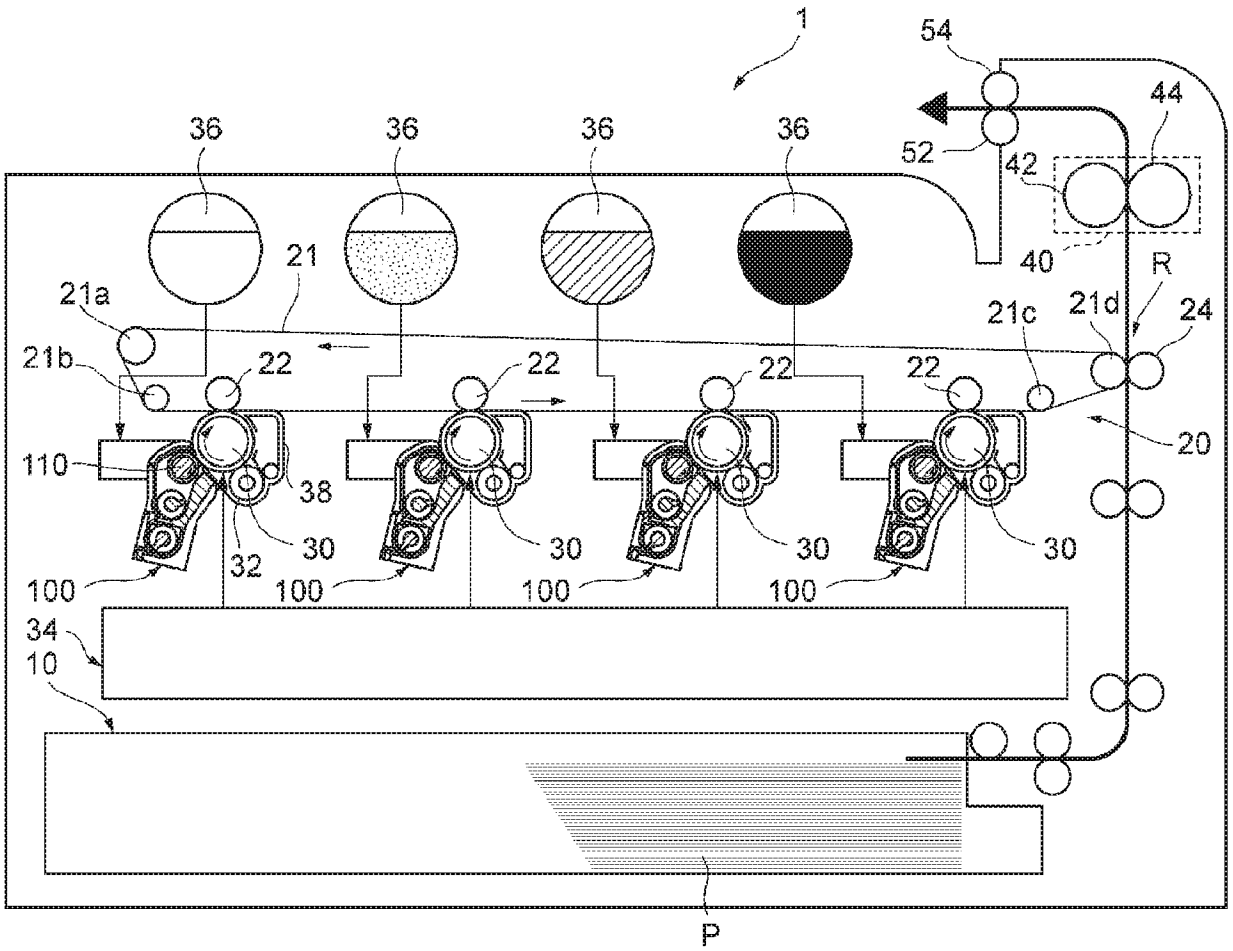
FIG. 1 is a schematic diagram of an image forming apparatus according to an embodiment of the present disclosure.

Hereinafter, exemplary embodiments of the present disclosure will be described with reference to the accompanying drawings. In the following description, identical elements or elements having identical functions will be referred to using identical reference numerals, and will not be described repeatedly.

As illustrated in FIG. 1, an image forming apparatus 1 according to an embodiment of the present disclosure may include a recording medium transport unit 10, a transfer unit 20, four photosensitive drums 30, four developing units 100, and a fixing unit 40 (a fixing device).

The recording medium transport unit 10 receives a recording medium on which an image is finally recorded, for example, paper P, and transports the paper P to a recording medium transport line. Herein, as well as the paper P, the recording medium may be an overhead projector (OHP) film. For example, the paper P may be received by being stacked in a cassette. The recording medium transport unit 10 transports the paper P to a secondary transfer region R at a point in time when a toner image transferred onto the paper P arrives at the secondary transfer region R.

The transfer unit 20 may be transported to the secondary transfer region R to secondarily transfer a toner image formed by the four developing units 100 onto the paper P that is a recording medium. The transfer unit 20 may include a transfer belt 21, rotating rollers 21*a*, 21*b*, 21*c*, and 21*d* for rotating the transfer belt 21, primary transfer rollers 22 for passing the transfer belt 21 over the photosensitive drums 30, and a secondary transfer roller 24 for passing the transfer belt 21 over the rotating roller 21*d*.

The transfer belt 21 is a seamless belt rotated by the rotating roller 21*a*, 21*b*, 21*c*, and 21*d*. The primary transfer roller 22 applies pressure from an inner circumferential side of the transfer belt 21 to the photosensitive drums 30. The secondary transfer roller 24 applies pressure from an outer circumferential side of the transfer belt 21 to the rotating roller 21*d*. The transfer unit 20 may further include a belt cleaning device (not shown) for removing toner attached to the transfer belt 21.

Each photosensitive drum 30 is an electrostatic latent image holding member on a circumference surface of which an image is formed, and may include, for example, an organic photo conductor (OPC). The image forming apparatus 1 may form a color image, and the four photosensitive drums 30 corresponding to, for example, magenta, yellow, cyan, and black, respectively, may be arranged along a moving direction of the transfer belt 21. On a circumference of each of the photosensitive drums 30, an electrifying roller 32, an exposure unit 34, a developing unit 100, and a cleaning unit 38 are arranged as illustrated in FIG. 1.

The electrifying roller 32 uniformly electrifies a surface of the photosensitive drum 30 by applying an electric charge thereto. The exposure unit 34 exposes the surface of the photosensitive drum 30 electrified by the electrifying roller 32, and in this case, the surface of the photosensitive drum 30 may be exposed to correspond to an image to be formed on the paper P that is a recording medium. Thus, a potential of an exposed portion of the surface of the photosensitive drum 30, which is exposed by the exposure unit 34, may change, such that an electrostatic latent image may be formed. Each of the four developing units 100 is supplied with toner from toner banks 36 arranged to respectively correspond to each of the four developing units 100, develops the electrostatic latent image formed on the photosensitive drum 30 using the toner supplied from the toner tank 36, and generates a toner image. For example, in the four toner tanks 36, magenta toner, yellow toner, cyan toner, and black toner may be charged, respectively.

The cleaning unit 38 collects toner remaining in the photosensitive drum 30 after the toner image formed on the photosensitive drum 30 is primarily transferred to the transfer belt 21. The cleaning unit 38 may include, for example, a cleaning blade, and removes the remaining toner on the photosensitive drum 30 by bringing the cleaning blade into contact with a circumferential surface of the photosensitive drum 30. An antistatic lamp (not shown) for resetting a potential of the photosensitive drum 30 between the cleaning unit 38 and the electrifying roller 32 may be arranged on a circumferential portion of the photosensitive drum 30.

The fixing unit 40 attaches and fixes the toner image secondarily transferred onto the paper P from the transfer belt 21 onto the paper P that is a recording medium. The fixing unit 40 according to an embodiment may include, for example, a heating roller 42 and a pressing roller 44. The heating roller 42 is a cylindrical member that is capable of rotating with respect to a rotation axis, and may have a heat source, such as a halogen lamp, installed therein. The pressing roller 44 is a cylindrical member that is capable of rotating with respect to a rotation axis and applies pressure to the heating roller 42. On an outer circumferential surface of the heating roller 42 and the pressing roller 44, a heat-resistant elastic layer, for example, silicon rubber, may be arranged. By causing the paper P to pass through a nip portion N, which is a contact region formed between the heating roller 42 and the pressing roller 44, the toner image may be fused and fixed onto the paper P.

The image forming apparatus 1 according to an embodiment may further include discharging rollers 52 and 54 for discharging the paper P on which the toner image is fixed by the fixing unit 40 to the outside of the image forming apparatus 1.

Next, a method of operating the image forming apparatus 1 will be described. Once an image signal of an image to be recorded is input to the image forming apparatus 1, a controller of the image forming apparatus 1 uniformly electrifies the surface of the photosensitive drum 30 by applying an electric charge thereto via the electrifying roller 32 according to the input image signal.

Next, by irradiating laser light onto the surface of the photosensitive drum 30 while using the exposure unit 34, an electrostatic latent image may be formed.

Meanwhile, the developing unit 100 mixes and stirs the toner and a carrier, and a developing agent produced by mixing the toner with the carrier may be held in a developing roller 110. If the developing agent is transported to a region facing the photosensitive drum 30 due to rotation of the developing roller 110, the toner of the developing agent held in the developing roller 110 moves to the electrostatic latent image formed on the circumferential surface of the photosensitive drum 30, such that the electrostatic latent image is developed. The toner image formed in this way is primarily transferred from the photosensitive drum 30 toward the transfer belt 21 in a region where the photosensitive drum 30 and the transfer belt 21 are arranged to face each other. In the transfer belt 21, toner images formed on the four photosensitive drums 30 are sequentially stacked, forming one stacked toner image.

The stacked toner image is transported to a secondary transfer region R in which the rotating roller 21*d* and the secondary transfer roller 24 face each other, and is then secondarily transferred onto the paper P transported from the recording medium transport unit 10 in the secondary transfer region R.

The paper P onto which the stacked toner image is secondarily transferred is transported to the fixing unit 40. By applying heat and pressure to the paper P in the foregoing process of causing the paper P to pass between the heating roller 42 and the pressing roller 44, the stacked toner image is fused and fixed onto the paper P.

The paper P is discharged to the outside of the image forming apparatus 1 by the discharging rollers 52 and 54. When the transfer belt 21 includes a belt cleaning device, the toner remaining on the transfer belt 21 after the secondary transfer of the stacked toner image onto the paper P may be removed by the belt cleaning device.

Figure 2:
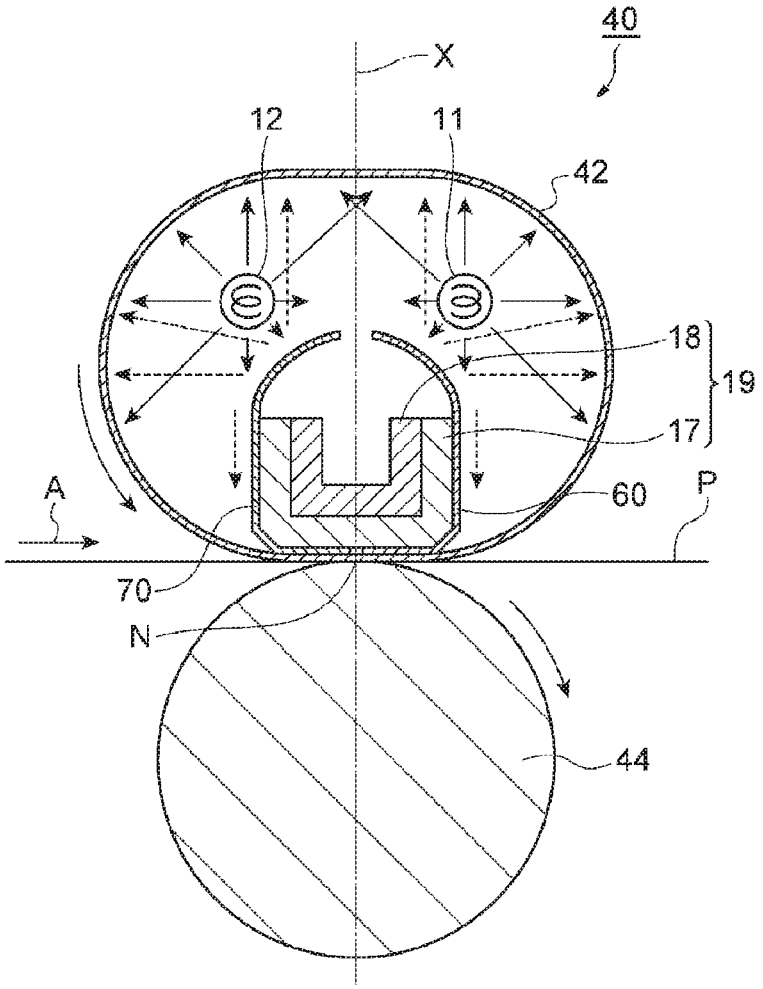
FIG. 2 is a cross-sectional view of a fixing device according to an embodiment of the present disclosure.

Referring to FIG. 2, the fixing unit 40 will be described in more detail. FIG. 2 is a cross-sectional view of the fixing device 40 according to an embodiment of the present disclosure. As illustrated in FIG. 2, the fixing unit 40 may include a heating roller 42 (a heating rotator), a first halogen lamp 11 (hereinafter, referred to as a 'first halogen lamp'), a second halogen lamp 12 (hereinafter, referred to as a 'second halogen lamp'), a first reflection member 60 (hereinafter, referred to as a 'first reflection member'), a second reflection member 70 (hereinafter, referred to as a 'second reflection member'), and a pressing roller 44 (a pressing rotator).

The heating roller 42 is a fixing member for thermally fixing a toner image (a non-fixed image) electrostatically transferred onto the paper P by using the pressing roller 44. The heating roller 42 and the pressing roller 44 may be arranged to face each other. The heating roller 42 according to an embodiment may be in the form of, for example, a belt. However, the present disclosure is not limited to the foregoing example, and the heating roller 42 may be in the form of a roller. For example, the heating roller 42 may have a hollow cylindrical shape, and a rotation-axis direction (widthwise direction) of the heating roller 42 may approximately coincide with a widthwise direction of the paper P. Hereinafter, an extended distance of the heating roller 42, which is measured along a rotation-axis direction of the heating roller 42, will be simply referred to as a width of the heating roller 42.

The heating roller 42 may include a cylindrical center portion including a metallic material, such as aluminum or iron, and a heterogeneous layer stacked on an outer circumference of the center portion. The heterogeneous layer may include a heterogeneous material such as a fluoropolymer film, e.g., perfluoroether (PFA) or polytetrafluoroethylene (PTFE), to facilitate electrification. The heating roller 42 is rotated in a direction, e.g., in a counterclockwise direction, by a rotation shaft connected to an actuator (not shown) by using a gear.

Inside the heating roller 42, a pressing portion 19, the first halogen lamp 11, the second halogen lamp 12, the first reflection member 60, and the second reflection member 70 are arranged. Between the pressing portion 19 and the heating roller 42, transverse portions 62*b* and 72*b* (refer to FIG. 4) of the first reflection member 60 and the second reflection member 70 are arranged. The pressing portion 19 applies pressure to the heating roller 42 by using the transverse portions 62*b* and 72*b* of the first reflection member 60 and the second reflection member 70, and the pressing portion 19 is provided with pressure from the pressing roller 44. The pressing portion 19 according to an embodiment may include, for example, a first supporting material 17 and a second supporting material 18. The first supporting material 17 may be made of, for example, steel, and the second supporting material 18 may be made of, for example, resin. The first supporting material 17 and the second supporting material 18 according to an embodiment may be arranged in an order of the first supporting material 17 and then the second supporting material 18 from the nip portion N. However, the present disclosure is not limited to this example, and the pressing portion 19 according to an embodiment may be implemented using, for example, a single member formed of one material.

Inside the heating roller 42, the first halogen lamp 11 and the first reflection member 60 are arranged at a side with respect to a virtual line X (to the right), and the second halogen lamp 12 and the second reflection member 70 are arranged at the other side with respect to the virtual line X (to the left). That is, the first halogen lamp 11 and the first reflection member 60 are arranged symmetrically with the second halogen lamp 12 and the second reflection member 70 with respect to the virtual line X. Herein, the virtual line X indicates a line that passes through the center of the nip portion N and is orthogonal to a tangent line of the nip portion N.

The first halogen lamp 11 and the second halogen lamp 12 are heat emitters that heat the heating roller 42. The first halogen lamp 11 and the second halogen lamp 12 are arranged to extend along a rotation-axis direction of the heating roller 42, and the first halogen lamp 11 and the second halogen lamp 12 are arranged to extend approximately in parallel with each other.

Figure 3:
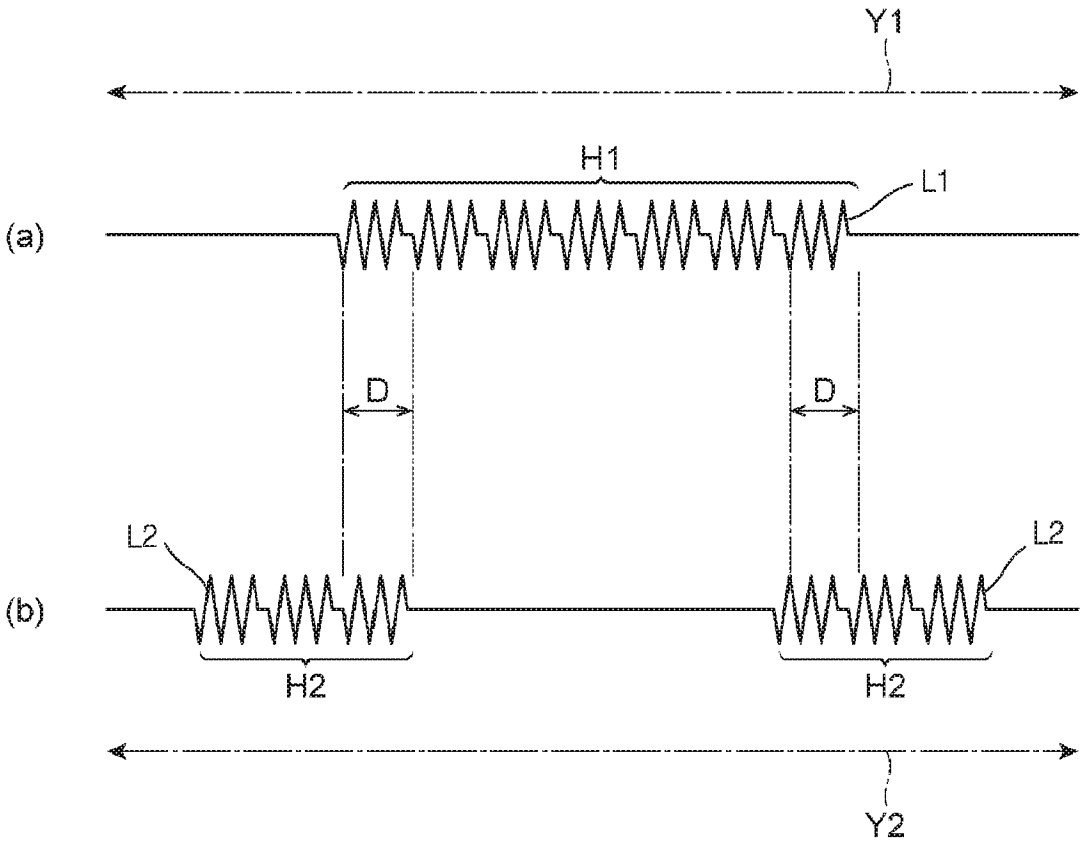
FIG. 3 illustrates conceptual views of a first halogen lamp and a second halogen lamp according to an embodiment of the present disclosure.

FIG. 3 illustrates conceptual views of the first halogen lamp 11 and the second halogen lamp 12 according to an embodiment of the present disclosure. (a) of FIG. 3 is a schematic diagram of the first halogen lamp 11, and (b) of FIG. 3 is a schematic diagram of the second halogen lamp 12. An axis direction Y1 (a first axis direction) of the first halogen lamp 11 and an axis direction Y2 (a second axis direction) of the second halogen lamp 12 may approximately coincide with a rotation-axis direction of the heating roller 42, that is, a widthwise direction of the paper P.

As shown in (a) of FIG. 3, the first halogen lamp 11 according to an embodiment may include, for example, a center portion-heating arrangement L1. The center portion-heating arrangement L1 is a heater for further heating the center portion of the heating roller 42 more than opposite end portions of the heating roller 42 and applies more heat to the center portion than opposite end portions positioned along the axis direction Y1 of the first halogen lamp 11. The center portion-heating arrangement L1 may include a first heat-emitting region H1 for applying heat to the center portion of the heating roller 42. A center portion along the rotation-axis direction of the heating roller 42 (hereinafter, referred to as the center portion of the heating roller 42) may include, for example, a region extending over a predetermined range (e.g., from approximately 70 mm to approximately 120 mm) outwardly from the center of the entire width of the heating roller 42. The width of the center portion of the heating roller 42 may be substantially equal to, for example, the width of the narrow-width paper P. That is, the first halogen lamp 11 applies heat to a region of the heating roller 42 corresponding to the narrow-width paper P.

The width of the first heat-emitting region H1 may extend further by a predetermined range (e.g., greater than approximately 0 mm and less than approximately 20 mm) than the width of a center portion of the heating roller 42, i.e., the width of the narrow-width paper P. An amount of heat per unit length, irradiated from the first heat-emitting region H1, may be, for example, greater than or equal to at least approximately 2 W/mm. A non-heat-emitting region (i.e., opposite end portions with respect to the axis direction Y1 of the first halogen lamp 11), other than the first heat-emitting region H1, may not emit heat, or may apply a smaller amount of heat, for example approximately 1 W/mm or less, to the heating roller 42 than to the first heat-emitting region H1, such that the non-heat-emitting region may be regarded as not contributing to heating of the heating roller 42.

As shown in (b) of FIG. 3, the second halogen lamp 12 according to an embodiment may include, for example, an end portion-heating arrangement L2. The end portion-heating arrangement L2 is a heater for further heating the opposite end portions of the heating roller 42 than the center portion of the heating roller 42, and applies more heat to the opposite end portions than to the center portion positioned along the axis direction of the second halogen lamp 12. The end portion-heating arrangement L2 may include a second heat-emitting region H2 for applying heat to the opposite end portions of the heating roller 42 with respect to the rotation-axis direction of the heating roller 42. The opposite end portions positioned along the rotation-axis direction of the heating roller 42 (hereinafter, referred to as the opposite end portions of the heating roller 42) may refer to, for example, an outer region with respect to the center portion of the heating roller 42. The opposite end portions of the heating roller 42 corresponds to a region between a first position spaced apart from the center of the heating roller 42 by a range (e.g., greater than or equal to approximately 70 mm and less than approximately 120 mm) and a second position spaced apart from the center of the heating roller 42 by a range (e.g., approximately 160 mm). The width corresponding to both the center portion and the opposite side end portions of the heating roller 42 may be substantially equal to, for example, the width of the wide-width paper P. That is, the second halogen lamp 12 applies heat to a region of the heating roller 42 corresponding to the wide-width paper P by using the first halogen lamp 11.

The width corresponding to both the first heat-emitting region H1 and the second heat-emitting region H2 may be larger than the width corresponding to both the center portion and the opposite end portions of the heating roller 42, that is, the width of the wide-width paper P, by a range (e.g., greater than approximately 0 mm and less than approximately 10 mm). The second heat-emitting region H2 is a region having an amount of heat per unit length that may be, for example, greater than or equal to at least approximately 2 W/mm. A non-heat-emitting region (i.e., the center portion of the second halogen lamp 12) other than the second heat-emitting region H2 may not emit heat, or applies a smaller amount of heat to the heating roller 42 than to the second heat-emitting region H2 by a range, e.g., approximately 1 W/mm or less, such that the non-heat-emitting region may be regarded as not contributing to heating of the heating roller 42.

By the heat-emitting regions H1 and H2 formed in the first halogen lamp 11 and the second halogen lamp 12, respectively, an overlapping heated region D may be formed. The overlapping heated region D is an overlapping region between the first heat-emitting region H1 of the first halogen lamp 11 and the second heat-emitting region H2 of the second halogen lamp 12 along the axis directions Y1 and Y2. The width of the overlapping heat-emitting region D arranged along the axis directions Y1 and Y2 may be, for example, greater than or equal to approximately 0 mm and less than approximately 20 mm.

However, the present disclosure is not limited to the foregoing example, and the heat-emitting regions H1 and H2 formed in the first halogen lamp 11 and the second halogen lamp 12 are not limited to the above-described region. For example, the width of the first heat-emitting region H1 along the axis directions Y1 and Y2 may be, for example, substantially the same as the width of the narrow-width paper P, and the width of a region including the first heat-emitting region H1 and the second heat-emitting region H2 along the axis directions Y1 and Y2 may be, for example, substantially the same as the width of the wide-width paper P. The first heat-emitting region H1 and the second heat-emitting region H2 may not overlap with each other along the axis directions Y1 and Y2. The arrangements of the first halogen lamp 11 and the second halogen lamp 12 may respectively cause heat to be applied to the heating roller 42 with a substantially identical heat emission in the center portion and the opposite end portions along the axis directions Y1 and Y2. That is, the arrangements of the first halogen lamp 11 and the second halogen lamp 12 may be the same as each other.

Referring to FIG. 2, the first reflection member 60 is arranged to correspond to the first halogen lamp 11. The first reflection member 60 is arranged such that the surface thereof faces the first halogen lamp 11, and thus light irradiated from the first halogen lamp 11 is reflected to the heating roller 42. The first reflection member 60 is arranged such that the surface thereof does not face the first halogen lamp 12, and thus light irradiated from the second halogen lamp 12 is not reflected to the heating roller 42. The first reflection member 60 is arranged closer to the nip portion N than to the first halogen lamp 11. The first reflection member 60 extends along an axis direction of the first halogen lamp 11. The first reflection member 60 is a leaf-type member and may be in a half pipe shape having an open side along the virtual line X. The first reflection member 60 will be described in more detail with reference to FIG. 4.

The second reflection member 70 is arranged to correspond to the second halogen lamp 12. The second reflection member 70 is arranged such that the surface thereof faces the second halogen lamp 12, and thus light irradiated from the second halogen lamp 12 is reflected to the heating roller 42. The second reflection member 70 is arranged such that the surface thereof does not face the first halogen lamp 11, and thus light irradiated from the first halogen lamp 11 is not reflected to the heating roller 42. The second reflection member 70 is arranged closer to the nip portion N than to the second halogen lamp 12. The second reflection member 70 extends along an axis direction of the second halogen lamp 12. The second reflection member 70 is a leaf-type member and may be in a half pipe shape having an open side along the virtual line X. The second reflection member 70 will be described in more detail with reference to FIG. 4.

The first reflection member 60 and the second reflection member 70 may be arranged approximately in parallel with each other to extend along an axis direction. The open side of the first reflection member 60 and the open side of the second reflection member 70 are arranged to face each other with respect to the virtual line X. The first reflection member 60 and the second reflection member 70 are arranged independently of each other in a non-contact manner. For example, the first reflection member 60 and the second reflection member 70 may be supported by being inserted between the supporting material 17 and the heating roller 42. The pressing roller 44, which is a pressing member, applies pressure to the heating roller 42 to press-contact the heating roller 42. The pressing roller 44 according to an embodiment may be, for example, in the form of a roller, but may also be in the form of a belt. The pressing roller 44 applies pressure to a toner image electrostatically transferred onto the paper P by using the heating roller 42, thus fixing the toner image onto the paper P.

The pressing roller 44 may include a center portion that is formed of a metallic material such as stainless steel or the like in a cylindrical shape, an elastic layer stacked on an outer circumference of the center portion, and a heterogeneous layer stacked on an outer circumference of the elastic layer. The elastic layer may include an elastic material, for example, silicon rubber, fluoro rubber, or the like. The heterogeneous layer may include a heterogeneous material such as a fluoro resin film like PFA, PTFE, or the like. The pressing roller 44 rotates in a direction, e.g., in a clockwise direction, by an actuator (not shown) connected to a rotation shaft using a gear. The pressing roller 44 press-contacts with the heating roller 42 and forms the nip portion N between the pressing roller 44 and the heating roller 42. The paper P is transferred in a paper transfer direction A, and the paper P may pass through the nip portion N.

Figure 4:
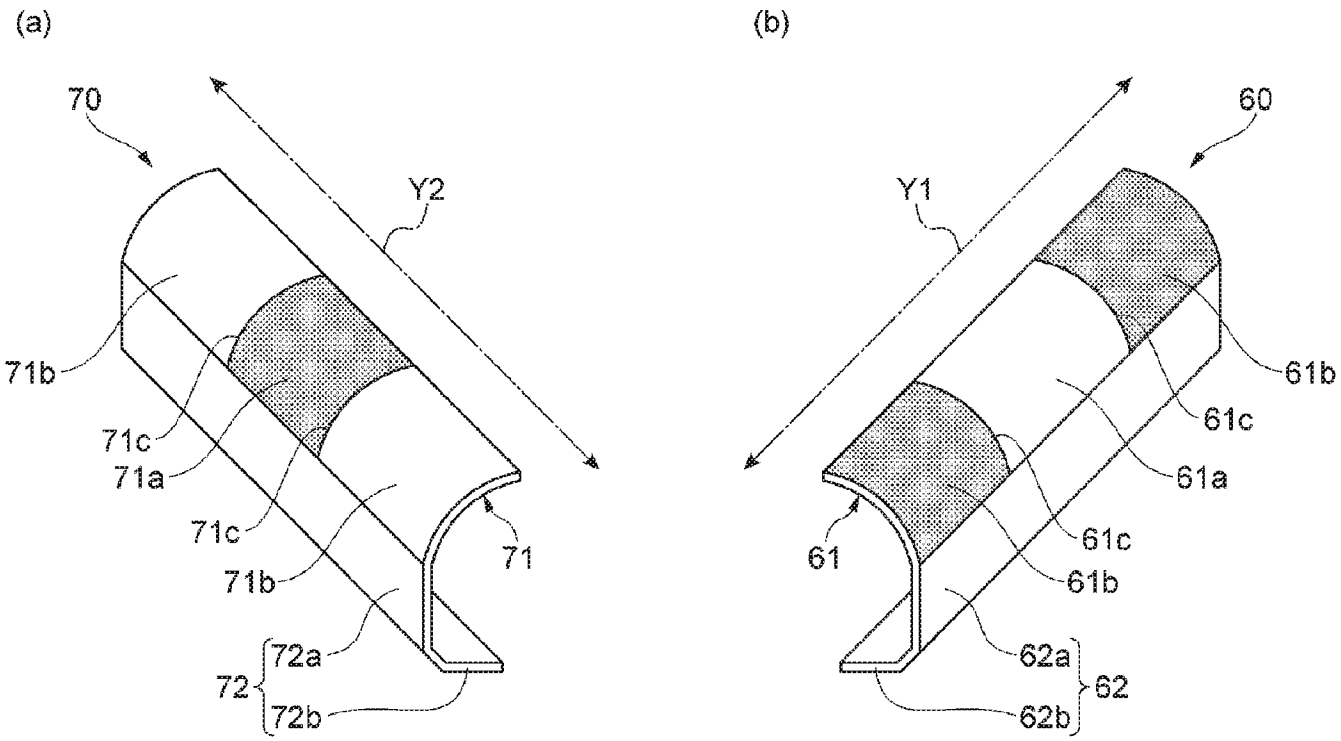
FIG. 4 illustrates perspective views of a reflection member illustrated in FIG. 2.

Referring to FIG. 4, the first reflection member 60 and the second reflection member 70 will be described in more detail. FIG. 4 is a schematic perspective view of the first reflection member 60 and the second reflection member 70 shown in FIG. 2. (a) of FIG. 4 is a perspective view of the second reflection member 70. For the sake of description, in (a) of FIG. 4, an axis direction Y2 of the second halogen lamp 12 is indicated by a dashed dotted arrow. (b) of FIG. 4 is a perspective view of the first reflection member 60. For the sake of description, in (b) of FIG. 4, an axis direction Y1 of the first halogen lamp 11 is indicated by a dashed dotted arrow. The axis direction Y1 and the axis direction Y2 may be substantially parallel with each other, and may substantially coincide with the rotation axis direction of the heating roller 42, that is, the widthwise direction of the paper P.

As shown in (b) of FIG. 4, the first reflection member 60 may include a reflection unit (hereinafter, referred to as a 'first reflection unit') 61 and a heat transfer unit (hereinafter, referred to as a 'first heat transfer unit') 62. The first reflection unit 61 faces the first halogen lamp 11 and is formed to have a curved shape. The first reflection unit 61 reflects light irradiated from the first halogen lamp 11 to the center portion of the heating roller 42. A reflectivity of the first reflection unit 61 is less than approximately 100%. That is, the first reflection unit 61 may not reflect all light irradiated from the first halogen lamp 11 and may absorb some light that is not reflected. Hereinafter, the reflectivity of light will be simply referred to as reflectivity.

The first reflection unit 61 has a higher reflectivity in the center portion than in the opposite end portions positioned along the axis direction Y1. That is, in the first reflection unit 61, a reflectivity of the opposite end portions is lower than that of the center portion. Herein, the lower reflectivity of the opposite end portions than that of the center portion positioned along the axis direction Y1 includes a case where light is not reflected from the opposite end portions positioned along the axis direction Y1 as well as a case where the reflectivity of the opposite end portions positioned along the axis direction Y1 is lower than that of the center portion.

More specifically, the first reflection unit 61 may include a center-portion surface 61*a* on the center portion positioned along the axis direction Y1 (hereinafter, referred to as a "first center-portion surface') and an end-portion surface 61*b* on the opposite end portions positioned along the axis direction Y1 (hereinafter, referred to as a 'first end-portion surface'). The first center-portion surface 61*a* and the first end-portion surface 61*b* face the first halogen lamp 11. The first end-portion surface 61*b* has a lower reflectivity than the first center-portion surface 61*a*. That is, the first end-portion surface 61*b* may be surface-treated to have a lower reflectivity than the first center-portion surface 61*a*, and the first center-portion surface 61*a* may be surface-treated to have a higher reflectivity than the first end-portion surface 61*b*. For example, the first end-portion surface 61*b* may be blackened by plating or may include irregularities thereon by undergoing a rough-surface treatment, and the first center-portion surface 61*a* may include a mirror surface by undergoing a mirror-surface treatment.

A boundary 61*c* between the first center-portion surface 61*a* and the first end-portion surface 61*b* (i.e., a boundary between the center portion and the opposite end portions positioned along the axis direction Y1 of the first reflection unit 61) may be positioned, for example, in the overlapping heated region D (see FIG. 3) formed by the first halogen lamp 11 and the second halogen lamp 12. That is, the reflectivity of the first reflection unit 61 may be switched with respect to the overlapping heated region D. For example, when compared to the center portion positioned inward with respect to the boundary 61*c* falling within the overlapping heated region D, in the opposite end portions positioned outward with respect to the boundary 61*c*, the light irradiated from the first halogen lamp 11 may not be reflected well to the heating roller 42. Thus, in the overlapping heated region D, the reflectivity of light reflected to the heating roller 42 after being irradiated from the first halogen lamp 11 may be switched.

The first heat transfer unit 62 may have substantially the same width as the first reflection unit 61 along the axis direction Y1. The first heat transfer unit 62 may include a longitudinal portion 62*a* extending from the first reflection unit 61 to the heating roller 42 and a transverse portion 62*b* (a first contact portion) contacting an inner surface of the heating roller 42. The longitudinal portion 62*a* may extend along a direction intersecting the inner surface of the heating roller 42, and the transverse portion 62*b* may extend along the inner surface of the heating roller 42. The longitudinal portion 62*a* may transfer heat absorbed by the first reflection unit 61 to the transverse portion 62*b* arranged to contact the inner surface of the heating roller 42.

The transverse portion 62*b* may extend approximately in parallel with the inner surface of the heating roller 42. The transverse portion 62*b* may extend to the nip portion N on the inner surface of the heating roller 42 (see FIG. 2). The transverse portion 62*b* transfers the heat delivered from the longitudinal portion 62*a* to the heating roller 42. Thus, heat generated by light that is not reflected to the heating roller 42 from among the light irradiated to the first reflection unit 61 from the first halogen lamp 11 (hereinafter, referred to as 'first absorbed heat') may be transferred to the nip portion N.

As illustrated in (a) of FIG. 4, the second reflection member 70 may include a reflection unit (hereinafter, referred to as a 'second reflection unit') 71 and a heat transfer unit (hereinafter, referred to as a 'second heat transfer unit') 72. The second reflection unit 71 faces the second halogen lamp 12 and is formed in a curved shape. The second reflection unit 71 reflects light irradiated from the second halogen lamp 12 to the opposite end portions of the heating roller 42. A reflectivity of the second reflection unit 71 is less than approximately 100%. That is, the second reflection unit 71 may not reflect all light irradiated from the second halogen lamp 12 and may absorb some light that is not reflected.

That is, in the second reflection unit 71, a reflectivity of the opposite end portions is higher than that of the center portion. That is, the second reflection unit 71 has a lower reflectivity in the center portion than in the opposite end portions positioned along the axis direction Y2. Herein, the lower reflectivity of the center portion than that of the opposite end portions positioned along the axis direction Y2 includes a case where light is not reflected from the center portion positioned along the axis direction Y2 as well as a case where the reflectivity of the center portion positioned along the axis direction Y2 is lower than that of the opposite end portions positioned along the axis direction Y2.

More specifically, the second reflection unit 71 may include a center-portion surface 71*a* on the center portion positioned along the axis direction Y2 (hereinafter, referred to as a 'second center-portion surface') and an end-portion surface 71*b* on the opposite end portions positioned along the axis direction Y2 (hereinafter, referred to as a 'second end-portion surface'). The second center-portion surface 71*a* and the second end-portion surface 71*b* face the second halogen lamp 12. The second center-portion surface 71*a* may have a lower reflectivity than the second end-portion surface 71*b*. That is, the second end-portion surface 71*a* may be surface-treated to have a lower reflectivity than the second end-portion surface 71*b*, and the second end-portion surface 71*b* may be surface-treated to have a higher reflectivity than the second center-portion surface 71*a*. For example, the second center-portion surface 71*a* may be blackened by plating or may include irregularities thereon by undergoing a rough-surface treatment, and the second end-portion surface 71*b* may include a mirror surface by undergoing a mirror-surface treatment.

A boundary 71*c* between the second center-portion surface 71*a* and the second end-portion surface 71*b* (i.e., a boundary between the center portion and the opposite end portions positioned along the axis direction Y2 of the second reflection unit 71) may be positioned, for example, in the overlapping heated region D (see FIG. 3) formed by the first halogen lamp 11 and the second halogen lamp 12. That is, the reflectivity of the second reflection unit 71 may be switched with respect to the overlapping heated region D. In the overlapping heated region D, when compared to the opposite end portions positioned outward with respect to the boundary 71*c*, in the center portion positioned inward with respect to the boundary 71*c*, the light irradiated from the second halogen lamp 12 may not be reflected well to the heating roller 42. Thus, in the overlapping heated region D, the reflectivity of light reflected to the heating roller 42 after being irradiated from the second halogen lamp 12 may be switched.

The second heat transfer unit 72 may have substantially the same width as the second reflection unit 71 along the axis direction Y2. The second heat transfer unit 72 may include a longitudinal portion 72*a* extending from the second reflection unit 71 to the heating roller 42 and a transverse portion 72*b* (a second contact portion) contacting with an inner surface of the heating roller 42. The longitudinal portion 72*a* may extend along a direction intersecting the inner surface of the heating roller 42, and the transverse portion 72*b* may extend along the inner surface of the heating roller 42. The longitudinal direction 72*a* may transfer heat absorbed by the second reflection unit 71 to the transverse portion 72*b* arranged to contact with the inner surface of the heating roller 42.

The transverse portion 72*b* may extend approximately in parallel with the inner surface of the heating roller 42. The transverse portion 72*b* may extend to the nip portion N of the inner surface of the heating roller 42 (see FIG. 2). The transverse portion 72*b* transfers the heat delivered from the longitudinal portion 72*a* to the heating roller 42. Thus, heat generated by light that is not reflected to the heating roller 42 from among the light irradiated to the second reflection unit 71 from the second halogen lamp 12 (hereinafter, referred to as 'second absorbed heat') may be transferred to the nip portion N.

The first reflection unit 61 and the second reflection unit 71 are arranged independently of each other in a non-contact manner. More specifically, the first reflection unit 61 and the second reflection unit 71 are spaced apart from each other, having the virtual line X (see FIG. 2) therebetween, to avoid transferring heat to each other. That is, the reflectivity of light to the heating roller 42 by the first reflection unit 61 and the reflectivity of light to the heating roller 42 by the second reflection unit 71 may be independent of each other. In addition, an insulating material may be arranged between the first reflection unit 61 and the second reflection unit 71.

The transverse portion 62*b* and the transverse portion 72*b* may be arranged in a non-contact manner. More specifically, the transverse portion 62*b* and the transverse portion 72*b* are spaced apart from each other, having the virtual line X (see FIG. 2) therebetween, to avoid transferring heat to each other. That is, the degree of heat transfer by the transverse portion 62*b* and the degree of heat transfer by the transverse portion 72*b* may be independent of each other. Moreover, an insulating material may be arranged between the transverse portion 62*b* and the transverse portion 72*b*.

As stated above, with the fixing unit 40 and the image forming apparatus 1 including the same according to an embodiment, the reflectivity of light reflected to the heating roller 42 from the first reflection unit 61 and the reflectivity of light reflected to the heating roller 42 from the second reflection unit 71 may be switched corresponding to characteristics of the first halogen lamp 11 and the second halogen lamp 12, respectively. As a result, heated regions of the heating roller 42 heated by light irradiated from the first halogen lamp 11 and the second halogen lamp 12 relatively correspond to the paper P having different sizes. Thus, the heating roller 42 may be used efficiently according to the size of the paper P. The first absorbed heat is transferred to the heating roller 42 by the first heat transfer unit 62, and the second absorbed heat is transferred to the heating roller 42 by the second heat transfer unit 72. Thus, heat generated by light irradiated from the first halogen lamp 11 and the second halogen lamp 12 may be efficiently transferred to the heating roller 42, thereby improving the thermal efficiency of a heating device.

According to an embodiment, more light irradiated from the first halogen lamp 11 is reflected to the center portion of the heating roller 42 than to the opposite end portions of the heating roller 42 by the first reflection unit 61. Thus, in the heated region of the heating roller 42 heated by light irradiated from the first halogen lamp 11 (hereinafter, referred to as a 'first heated region'), a larger amount of heat is applied to the center portion of the heating roller 42 than to the opposite end portions of the heating roller 42. On the other hand, more light irradiated from the second halogen lamp 12 is reflected to the opposite end portions of the heating roller 42 than to the center portion of the heating roller 42 by the second reflection unit 71. Thus, in the heated region of the heating roller 42 heated by light irradiated from the second halogen lamp 12 (hereinafter, referred to as a 'second heated region'), a larger amount of heat is applied to the opposite end portions of the heating roller 42 than to the center portion of the heating roller 42. The first heated region according to an embodiment of the present disclosure is limited to a region corresponding to narrow-width paper P, whereas a combined heated region including the first heated region and the second heated region (hereinafter, referred to as a 'combined heated region') may correspond to wide-width paper P. Therefore, the heated region of the heating roller 42 may correspond relatively to paper P having different sizes.

According to an embodiment, the first heat-emission region H1 corresponding to the first halogen lamp 11 contributes to heating of the center portion of the heating roller 42, such that in the first heated region, a larger amount of heat is provided in the center portion than in the opposite end portions. The second heat-emission region H2 corresponding to the second halogen lamp 12 contributes to heating of the opposite end portions of the heating roller 42, such that in the second heated region, a larger amount of heat is provided in the opposite end portions than in the center portion. Therefore, the heated region of the heating roller 42 may correspond to paper P having different sizes.

In the combined heated region formed by the first halogen lamp 11 and the second halogen lamp 12, an amount of heat of the overlapping heated region D may be relatively large, such that heat distribution of the heating roller 42 may not be uniform. In this case, according to an embodiment, in an outer region with respect to the boundary 61*c* of the first reflection unit 61 along the axis direction Y1, a small amount of light irradiated from the first halogen lamp 11 may be reflected to the heating roller 42, and in an inner region with respect to the boundary 71*c* of the second reflection unit 71 along the axis direction Y2, a small amount of light irradiated from the second halogen lamp 12 may be reflected to the heating roller 42. As stated above, the reflectivity may be switched between the boundaries 61*c* and 71*c* included in the first reflection unit 61 and the second reflection unit 71, respectively, such that the reflectivity of light reflected to the overlapping heated region D after being generated from the first halogen lamp 11 and the second halogen lamp 12 may be adjusted and thus heat distribution of the combined heated region may be maintained to be uniform. As a result, when the combined heated region corresponds to the wide-width paper P, the wide-width paper P may be heated uniformly along the widthwise direction.

According to an embodiment, the first absorbed heat is transferred to the heating roller 42 by the transverse portion 62*b*, and at the same time, the second absorbed heat is transferred to the heating roller 42 by the transverse portion 72*b*. Thus, heat generated by light irradiated from the first halogen lamp 11 and the second halogen lamp 12 may be efficiently transferred to the heating roller 42 without being additionally exhausted.

The transverse portion 62*b* and the transverse portion 72*b* may be arranged in a non-contact manner, and are independent of each other, such that heat transfer by the transverse portion 62*b* and heat transfer by the transverse portion 72*b* may be switched corresponding to characteristics of the respective first halogen lamp 11 and second halogen lamp 12. Thus, heat generated by light irradiated from the first halogen lamp 11 and the second halogen lamp 12 may be efficiently transferred to the heating roller 42.

In addition, according to an embodiment, even when an actuating tool for moving the first reflection member 60 and the second reflection member 70 is not provided, the heated region of the heating roller 42 may correspond relatively to paper having different sizes, thereby reducing a manufacturing cost of the device.

Figure 5:
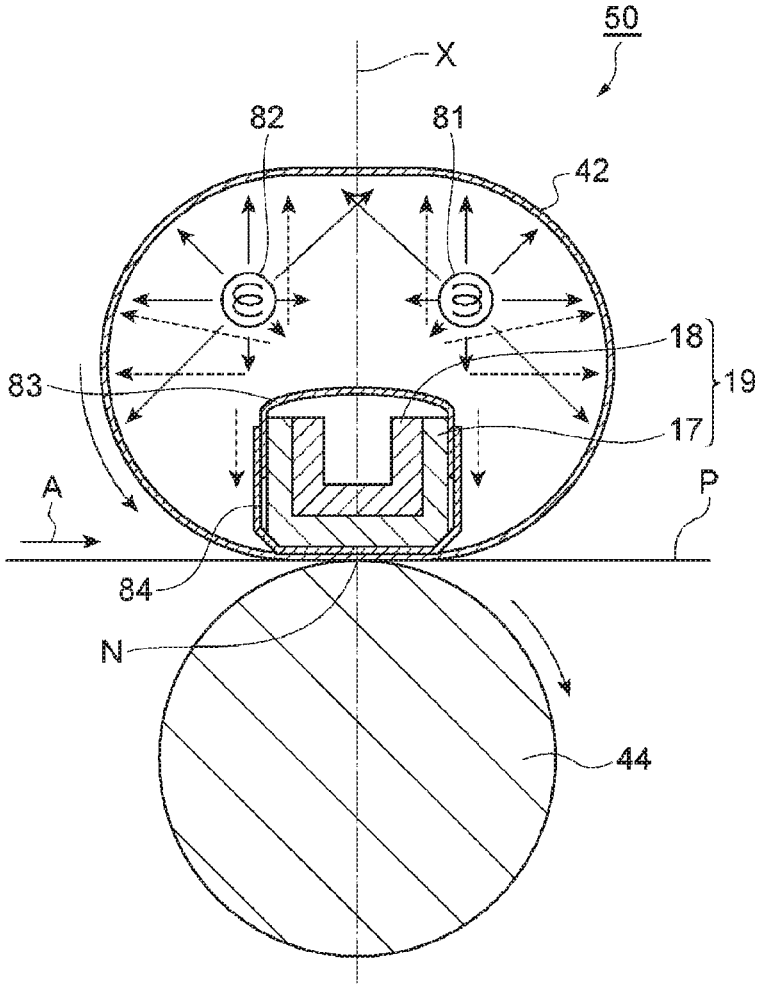
FIG. 5 is a cross-sectional view of a fixing unit according to a comparison example.
Figure 6:
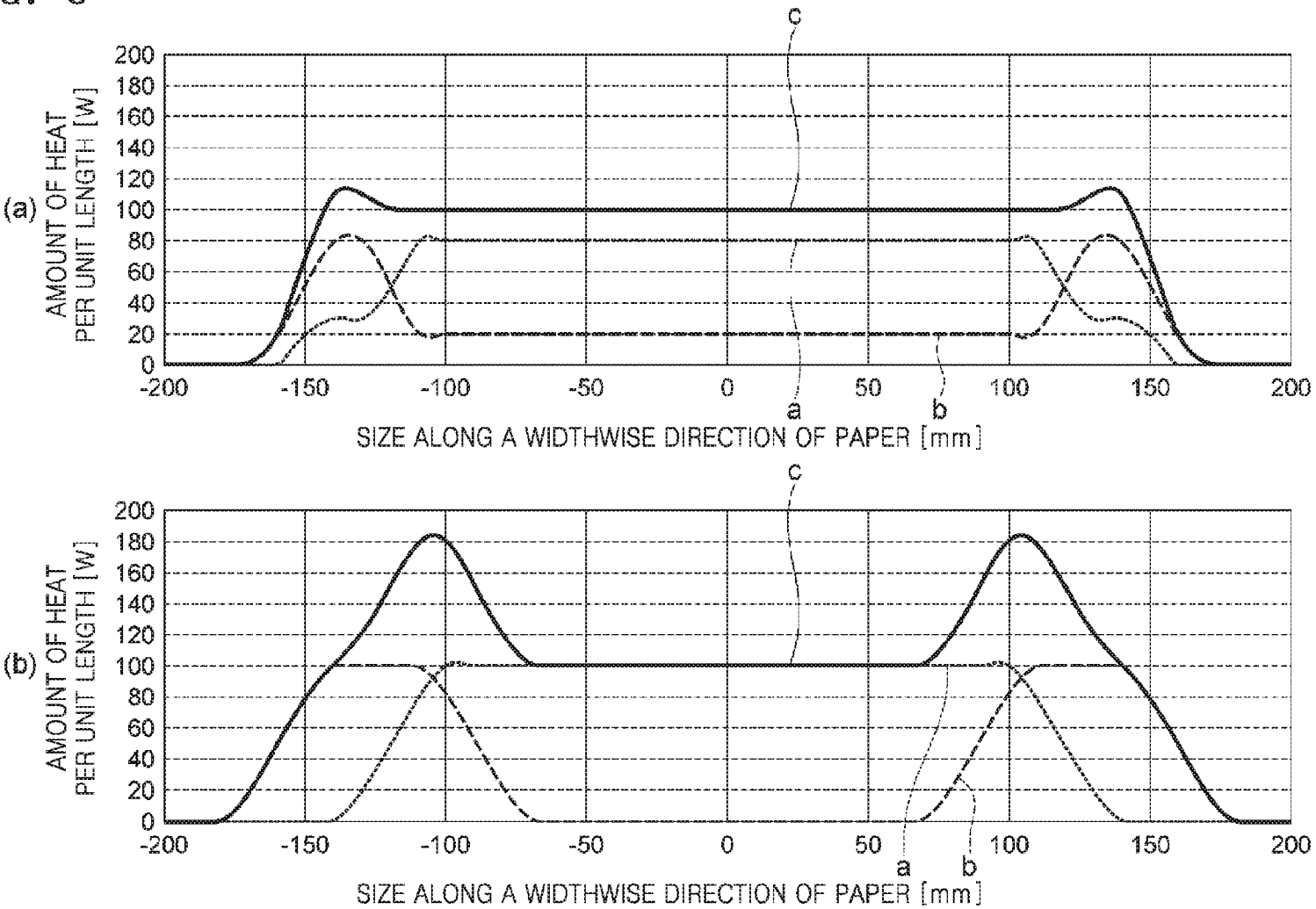
FIG. 6 illustrates graphs showing an example of heat distribution of a fixing unit illustrated in FIG. 5.
Figure 7:
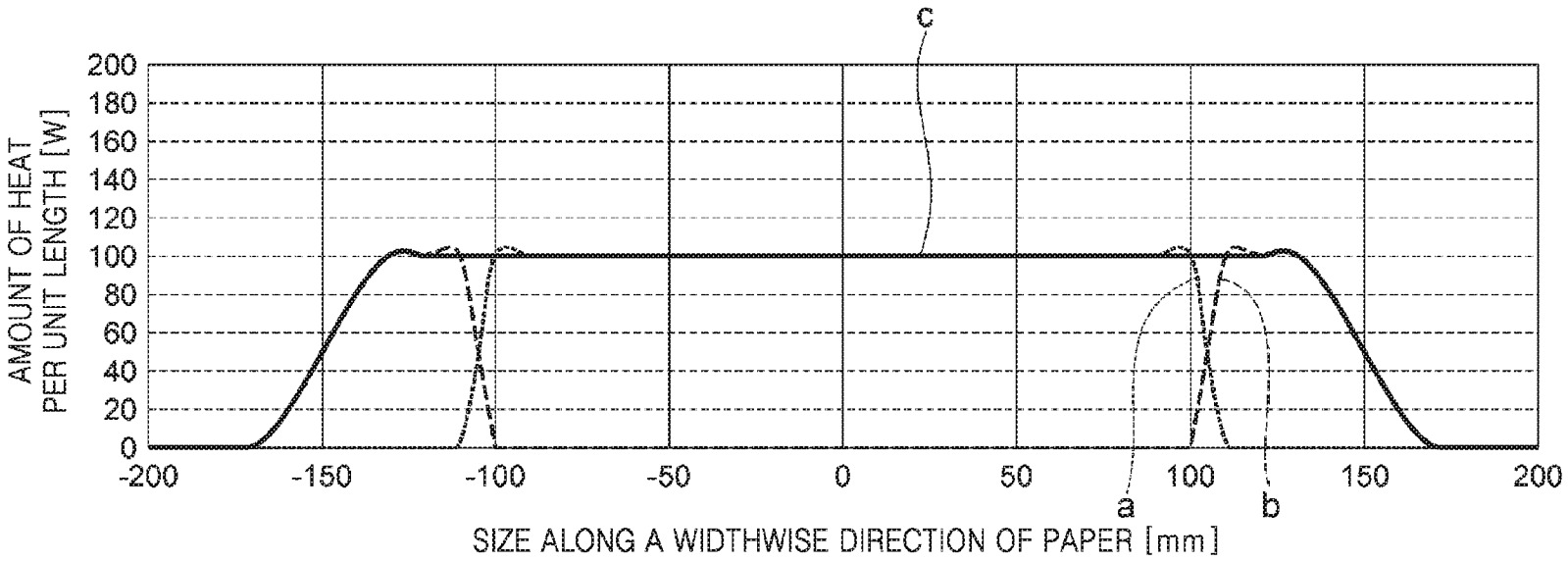
FIG. 7 is a graph showing an example of heat distribution of a fixing unit according to an embodiment of the present disclosure.

Herein, referring to FIGS. 5 through 7, when a center-portion heating lamp 81 and an end-portion heating lamp 82 are simply combined like in the fixing unit 50 shown in FIG. 5, it may be difficult to form a heated region corresponding to paper having different sizes. FIG. 5 is a cross-sectional view of a fixing unit 50 according to a comparison example.

As shown in FIG. 5, the fixing unit 50 according to the comparison example may include the heating roller 42 and the pressing roller 44, like the fixing unit 40 according to an embodiment of the present disclosure. The fixing unit 50 may include the center-portion heating lamp 81, the end-portion heating lamp 82, a reflection member 83, and a heat transfer unit 84 without including the first halogen lamp 11, the second halogen lamp 12, the first reflection member 60, and the second reflection member 70 of an embodiment of the present disclosure.

The center-portion heating lamp 81 and the end-portion heating lamp 82 are halogen lamps for heating the heating roller 42. The center-portion heating lamp 81 and the end-portion heating lamp 82 extend along the rotation axis direction of the heating roller 42. The center-portion heating lamp 81 and the end-portion heating lamp 82 are arranged approximately in parallel with each other. The axis direction of the center-portion heating lamp 81 and the end-portion heating lamp 82 approximately coincides with the rotation axis direction of the heating roller 42, that is, the widthwise direction of the paper P. The center-portion heating lamp 81 may include more heating arrangements in the center portion than in the opposite end portions arranged along the axis direction thereof. The end-portion heating lamp 82 may include more heating arrangements in the opposite end portions than in the center portion arranged along the axis direction thereof.

The reflection member 83 is arranged such that the surface of the reflection member 83 faces the center-portion heating lamp 81 and the end-portion heating lamp 82, and thus light irradiated from the center-portion heating lamp 81 and the end-portion heating lamp 82 may be reflected to the heating roller 42. The reflection member 83 is arranged closer to the nip portion N than to the center-portion heating lamp 81 and the end-portion heating lamp 82. The reflection member 83 is arranged to cover the first supporting material 17 and the second supporting material 18. The reflection member 83 extends along the axis direction of the center-portion heating lamp 81 and the end-portion heating lamp 82. The reflection member 83 is arranged to contact with the heat transfer unit 84. The reflection member 83 absorbs a part of light irradiated from the center-portion heating lamp 81 and the end-portion heating lamp 82, and transfers heat generated by the absorption to the heat transfer unit 84.

The heat transfer unit 84 is supported between the second supporting material 18 and the heating roller 42. The first supporting material 17 and the second supporting material 18 are arranged between the heat transfer unit 84 and the reflection member 83. The heat transfer unit 84 extends along an inner surface of the heating roller 42, and transfers heat transferred from the reflection member 83 to the heating roller 42.

An example of heat distribution by the center-portion heating lamp 81 and the end-portion heating lamp 82 included in the fixing unit 50 is shown in FIG. 6. In FIG. 6, a horizontal axis indicates a size (mm) along a widthwise direction of paper, and a vertical axis indicates an amount of heat (W) per unit length. Herein, heat distribution by combined arrangements included in the fixing unit 50 refers to heat distribution along a widthwise direction of paper P heated by both the center-portion heating lamp 81 and the end-portion heating lamp 82. The heat distribution along the widthwise direction of the paper P refers to a temperature distribution along the widthwise direction of the paper P when the paper P passes through the nip portion N. As shown in FIG. 6, a graph a indicates heat distribution along the widthwise direction of the paper P heated by the center-portion heating lamp 81; a graph b indicates heat distribution along the widthwise direction of the paper P heated by the end-portion heating lamp 82; and a graph c indicates heat distribution with the center-portion heating lamp 81 and the end-portion heating lamp 82.

Due to characteristics of a halogen lamp, light from the center-portion heating lamp 81 and the end-portion heating lamp 82 is diffused along the axis direction thereof. Thus, in the fixing unit 50, for example, as shown in (a) of FIG. 6, to maintain heat distribution with the center-portion heating lamp 81 and the end-portion heating lamp 82 uniformly, an amount of heat along the widthwise direction of the paper P heated by the center-portion heating lamp 81, i.e., the output of the center-portion heating lamp 81, needs to be small. However, if the output of the center-portion heating lamp 81 is reduced, productivity with respect to the narrow-width paper may not be maintained. To maintain productivity with respect to the narrow-width paper, if the output of the center-portion heating lamp 81 is not reduced as shown in (b) of FIG. 6, heat distribution of each of the center-portion heating lamp 81 and the end-portion heating lamp 82 may include an overlapping heated region along the axis direction Y1 and the axis direction Y2. As a result, heat distribution with the center-portion heating lamp 81 and the end-portion heating lamp 82 may not be maintained uniformly in the overlapping heated region.

On the other hand, with the fixing unit 40 and the image forming apparatus 1 according to an embodiment, by using the first reflection unit 61 corresponding to the first halogen lamp 11 and the second reflection unit 71 corresponding to the second halogen lamp 12, the reflectivity of light reflected to the heating roller 42 after being irradiated from the first halogen lamp 11 and the second halogen lamp 12 may be adjusted. Thus, without switching heat distribution applied by the first halogen lamp 11 and the second halogen lamp 12, heat distribution applied to the heating roller 42 may be changed. For example, according to the an embodiment, the reflectivity of the light irradiated by the first halogen lamp 11 and the second halogen lamp 12 and reflected from the overlapping heated region D may be adjusted because the boundaries 61*c* and 71*c* of the first and second reflection members 61 and 71 are located in the overlapping heated region, such that heat distribution of a combined heated region applied to the heating roller 42 may be adjusted to a uniform state. As a result, when the combined heated region corresponds to the wide-width paper P, the wide-width paper P may be heated uniformly along the widthwise direction thereof.

An example of combined heat distribution of the fixing unit 40 according to an embodiment is shown in FIG. 7. In FIG. 7, a horizontal axis indicates a size (mm) along the widthwise direction of paper, and a vertical axis indicates an amount of heat (W) per unit length. Herein, the combined heat distribution of the fixing unit 40 refers to a distribution of heat generated by the first halogen lamp 11 and the second halogen lamp 12 along the widthwise direction of the paper P, that is, the heat distribution of the combined heated region. The heat distribution along the widthwise direction of the paper P refers to a temperature distribution along the widthwise direction of the paper P when the paper P passes through the nip portion N. In FIG. 7, a graph a indicates heat distribution along the widthwise direction of the paper P heated by the first halogen lamp 11; a graph b indicates heat distribution along the widthwise direction of the paper P heated by the second halogen lamp 12; and a graph c indicates the combined heat distribution.

As shown in FIG. 7, the fixing unit 40 according to an embodiment may maintain the combined heat distribution uniform without having to reduce the amount of heat along the widthwise direction of the paper P heated by the first halogen lamp 11, that is, without having to reduce the output of the first halogen lamp 11, productivity even with respect to the narrow-width paper may be maintained. Therefore, with respect to the fixing unit 40 according to an embodiment of the present disclosure, when narrow-width paper is used, productivity may be maintained, and when wide-width paper is used, heat distribution along the widthwise direction of the paper P may be maintained uniformly.

A fixing unit (fixing device) according to an embodiment of the present disclosure may include the heating roller 42, the first halogen lamp 11, the second halogen lamp 12, and the pressing roller 44. The fixing unit according to an embodiment of the present disclosure may include a first-first reflection member 60A and a second-first reflection member 70A, instead of the first reflection member 60 and the second reflection member 70.

Figure 8:
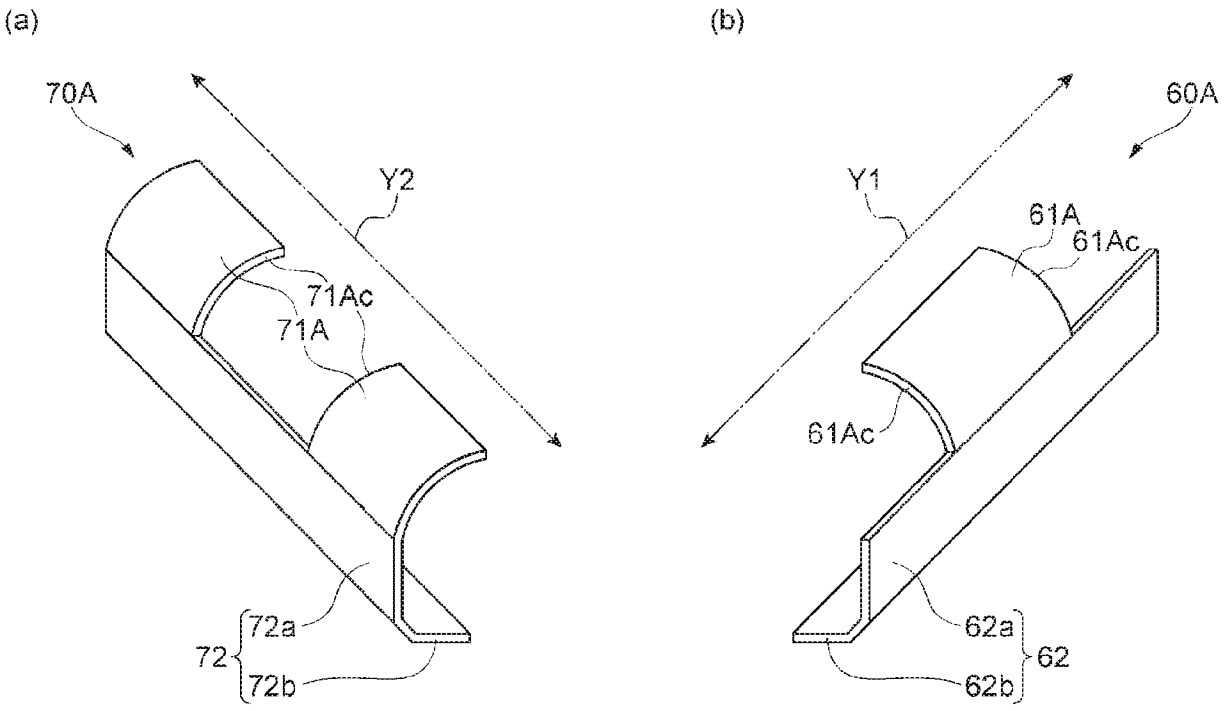
FIG. 8 illustrates perspective views of a reflection member of a fixing device according to an embodiment of the present disclosure.

FIG. 8 illustrates perspective views of the first-first reflection member 60A and the second-first reflection member 70A of the fixing device according to an embodiment of the present disclosure. FIG. 8 corresponds to FIG. 4 according to an embodiment of the present disclosure. As shown in (b) of FIG. 8, the first-first reflection member 60A according to an embodiment may include the first-first reflection unit 61A instead of the first reflection unit 61. The first-first reflection unit 61A according to an embodiment may have a higher reflectivity in the center portion than in the opposite end portions. For example, the first-first reflection unit 61A may be formed to have opposite end portions that are cut away. That is, the first-first reflection unit 61A is arranged in the center portion positioned along the axis direction Y1, but the separate opposite end portions of first-first reflection unit 61A may not be present. The first-first reflection unit 61A has a convex surface facing the first halogen lamp 11 and reflects light irradiated from the first halogen lamp 11 to the center portion of the heating roller 42. The first-first reflection unit 61A according to an embodiment may have a mirror surface by undergoing a mirror-surface treatment to have reflectivity. A reflectivity of the first-first reflection unit 61A may be less than approximately 100%. That is, the first-first reflection unit 61A may not reflect all light irradiated from the first halogen lamp 11 and may absorb some light that is not reflected.

Opposite end portions 61Ac of the first-first reflection unit 61A arranged along the axis direction Y1 (that is, a boundary between the center portion and the opposite end portions in the first-first reflection unit 61A) may include the overlapping heated region D (see FIG. 3). That is, the reflectivity of the first-first reflection unit 61A may be switched in the overlapping heated region D. In the overlapping heated region D, in the opposite end portions positioned outward with respect to the end portions 61Ac along the axis direction, the light irradiated from the first halogen lamp 11 may not be reflected to the heating roller 42. Thus, in the overlapping heated region D, the reflectivity of light reflected to the heating roller 42 after being irradiated from the first halogen lamp 11 may be adjusted.

As shown in (a) of FIG. 8, the second-first reflection member 70A according to an embodiment may include the second-first reflection unit 71A instead of the second reflection unit 71. In the second-first reflection unit 71A, a reflectivity of the opposite end portions is higher than that of the center portion. The second-first reflection unit 71A according to an embodiment may be formed such that the center portion positioned along the axis direction Y2 is cut away. That is, the second-first reflection unit 71A may be arranged to include the opposite end portions along the axis direction Y2, but the center portion along the axis direction Y2 is not included. The second-first reflection unit 71A has a convex surface facing the second halogen lamp 12 and reflects light irradiated from the second halogen lamp 12 to the opposite end portions of the heating roller 42. The second-first reflection unit 71A may have a mirror surface by undergoing a mirror-surface treatment to have reflectivity. A reflectivity of the second-first reflection unit 71A may be less than approximately 100%. That is, the second-first reflection unit 71A may not reflect all light irradiated from the second halogen lamp 12 and may absorb some light that is not reflected.

An end portion 71Ac included in the second-first reflection unit 71A (i.e., a boundary between the center portion and the opposite end portions of the second-first reflection unit 71A) may be positioned in the overlapping heated region D (see FIG. 3) in a heated region formed by the first halogen lamp 11 and the second halogen lamp 12. That is, the reflectivity of the second-first reflection unit 71A may be switched in the overlapping heated region D. In the overlapping heated region D, in the center portion arranged inward with respect to the end portion 71Ac along the axis direction, the light irradiated from the second halogen lamp 12 is not reflected to the heating roller 42. Thus, in the overlapping heated region D, the reflectivity of light reflected to the heating roller 42 after being irradiated from the second halogen lamp 12 may be adjusted.

As such, according to an embodiment of the present disclosure, light irradiated from the first halogen lamp 11 by the first-first reflection unit 61A is reflected to the center portion of the heating roller 42. Thus, in the first heated region, a larger amount of heat may be applied to the center portion than to the opposite end portions of the heating roller 42. On the other hand, the light irradiated from the second halogen lamp 12 by the second-first reflection unit 71A may be reflected to the opposite end portions of the heating roller 42. Thus, in the second heated region, a larger amount of heat may be applied to the opposite end portions than to the center portion of the heating roller 42. As a result, the heated region of the heating roller 42 may correspond relatively to paper P having different sizes, depending on use conditions.

In this case, according to an embodiment, in an outer region with respect to the end portion 61Ac of the first-first reflection unit 61A along the axis direction Y1, light irradiated from the first halogen lamp 11 may not be reflected to the heating roller 42, and in an inner region with respect to the end portion 71Ac of the second-first reflection unit 71A along the axis direction Y2, light irradiated from the second halogen lamp 12 may not be reflected to the heating roller 42. Because the end portions 61Ac and 71Ac of the first-first reflection unit 61A and the second-first reflection unit 71A in which a reflectivity switch occurs may be located in the overlapping heated region D, the reflectivity of light irradiated from the first halogen lamp 11 and the second halogen lamp 12 may be adjusted in the overlapping heated region D, such that heat distribution of the combined heated region may be adjusted uniformly. As a result, when the combined heated region corresponds to the wide-width paper P, the wide-width paper P may be heated uniformly along the widthwise direction of the wide-width paper P.

Figure 9:
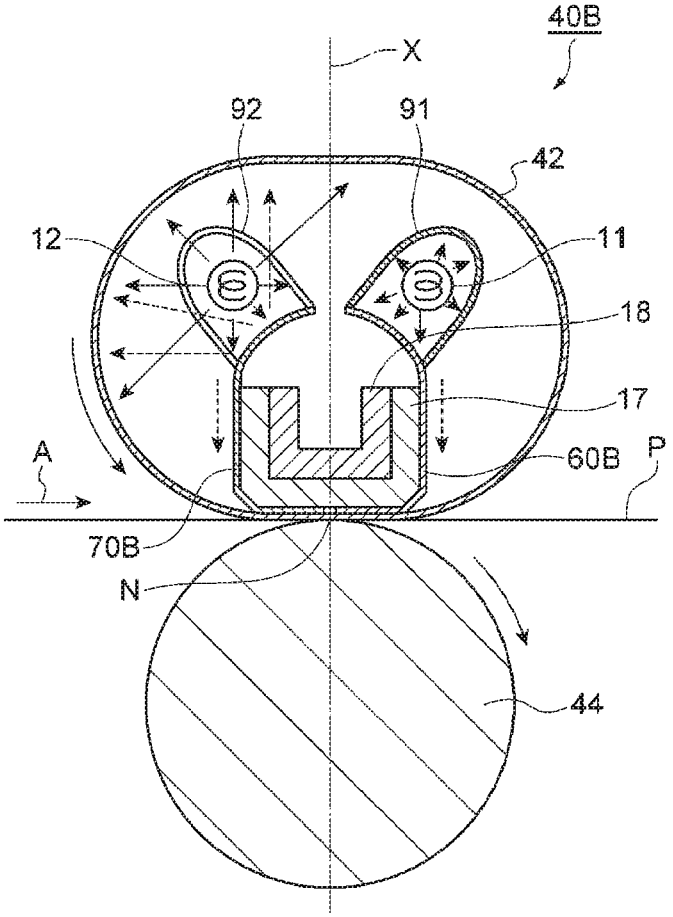
FIG. 9 is a cross-sectional view of a fixing device according to an embodiment of the present disclosure.

A fixing unit (fixing device) according to an embodiment of the present disclosure will be described with reference to FIGS. 9 and 10. FIG. 9 is a cross-sectional view of a fixing device according to an embodiment of the present disclosure. A fixing unit 40B according to an embodiment of the present disclosure may include the heating roller 42, the first halogen lamp 11, the second halogen lamp 12, and the pressing roller 44, like the fixing unit 40 according to an embodiment of the present disclosure. The fixing unit according to an embodiment of the present disclosure includes a first-second reflection member 60B and a second-second reflection member 70B, instead of the first reflection member 60 and the second reflection member 70.

Figure 10:
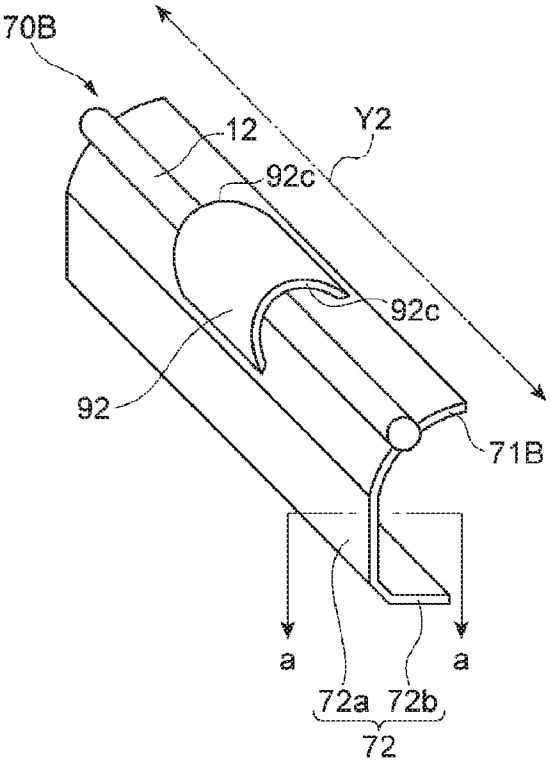
FIG. 10 illustrates perspective views of a reflection member illustrated in FIG. 8.
Figure 10:
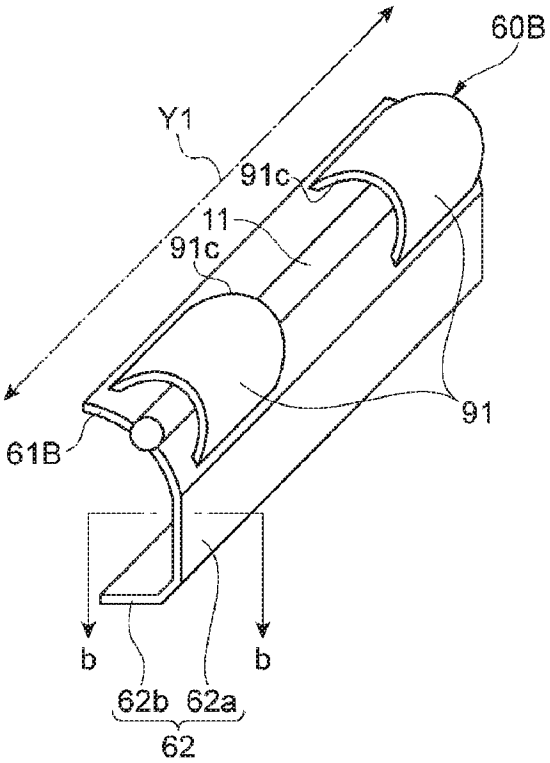

FIG. 10 illustrates schematic perspective views of the first-first reflection member 60B and the second-second reflection member 70B shown in FIG. 9. (a) of FIG. 10 illustrates the second-second reflection member 70B. For the sake of description, in (a) of FIG. 10, the axis direction Y2 of the second halogen lamp 12 is indicated by a dashed dotted arrow. (b) of FIG. 10 illustrates the first-second reflection member 60B. For the sake of description, in (b) of FIG. 10, the axis direction Y1 of the first halogen lamp 11 is indicated by a dashed dotted arrow. The axis direction Y1 and the axis direction Y2 may be substantially parallel with each other, and may substantially coincide with the widthwise direction of the paper P.

As shown in (b) of FIG. 10, the first-second reflection member 60B according to an embodiment may include the first-second reflection unit 61B instead of the first reflection unit 61. The surface of the first-second reflection unit 61B has an approximately constant reflectivity along the axis direction Y1, and for example, may have a mirror surface by undergoing a mirror-surface treatment. The first-second reflection unit 61B has a convex curved surface facing the first halogen lamp 11. The first-second reflection unit 61B reflects light irradiated from the first halogen lamp 11 to the heating roller 42. A reflectivity of the first-second reflection unit 61B may be less than approximately 100%. That is, the first-second reflection unit 61B may not reflect all light irradiated from the first halogen lamp 11 and may absorb some light that is not reflected.

In opposite end portions of the first-second reflection member 60B positioned along the axis direction Y1, a first light-shielding unit 91 may be arranged. The first light-shielding unit 91 has the first halogen lamp 11 interposed with the first-second reflection unit 61B. The first light-shielding unit 91 blocks reflection of the light irradiated from the first halogen lamp 11 to the opposite end portions of the heating roller 42. According to an embodiment, the first light-shielding unit 91 has a dome shape and covers a part of the first halogen lamp 11. The first light-shielding unit 91 blocks the light reflected by the first-second reflection unit 61B after being irradiated from the first halogen lamp 11, and also blocks incidence of the light directly applied from the first halogen lamp 11 to the opposite end portions of the heating roller 42.

An inner end portion 91*c* of the first light-shielding unit 91 is arranged in the overlapping heated region D (see FIG. 3) formed by the light irradiated from each of the first halogen lamp 11 and the second halogen lamp 12. For example, in the overlapping heated region D, a light-shielding rate of the first light-shielding unit 91 may be switched. In the overlapping heated region D, in the opposite end portions located outward with respect to the inner end portion 91*c* along the axis direction Y1, the light irradiated from the first halogen lamp 11 may not be reflected to the heating roller 42 relatively when compared to the center portion located inward with respect to the end portion 91*c* along the axis direction Y1. Thus, in the overlapping heated region D, the reflectivity of light reflected to the heating roller 42 after being irradiated from the first halogen lamp 11 may be switched.

As shown in (a) of FIG. 10, the second-second reflection member 70B according to an embodiment may include the second-second reflection unit 71B instead of the aforementioned second reflection unit 71. The second-second reflection unit 71B may have a mirror surface by undergoing a mirror-surface treatment to have an approximately constant reflectivity along the axis direction Y1. The second-second reflection unit 71B faces the second halogen lamp 12 and is formed to have a convex curved shape. The second-second reflection unit 71B reflects the light irradiated from the second halogen lamp 12 to the heating roller 42. A reflectivity of the second-second reflection unit 71B may be less than approximately 100%. That is, the second-second reflection unit 71B may not reflect all light irradiated from the second halogen lamp 12 and may absorb some light that is not reflected.

In the center portion positioned along the axis direction Y2 of the second-second reflection member 70B, a second light-shielding unit 92 may be arranged. In this case, the second halogen lamp 12 may be interposed between the second light-shielding unit 92 and the second-second reflection unit 71B. The second light-shielding unit 92 blocks reflection of the light irradiated from the second halogen lamp 12 to the center portion of the heating roller 42. The second light-shielding unit 92 may have a dome shape, and in this case, may cover a part of the second halogen lamp 12. The second light-shielding unit 92 blocks the light reflected by the second-second reflection unit 71B, and also blocks incidence of the light directly irradiated from the second halogen lamp 12 to the center portion of the heating roller 42.

An outer end portion 92*c* of the second light-shielding unit 92 is arranged in the overlapping heated region D (see FIG. 3) formed by the light irradiated from each of the first halogen lamp 11 and the second halogen lamp 12. For example, a light-shielding rate of the second light-shielding unit 92 may be switched in the overlapping heated region D. In the overlapping heated region D, in the center portion positioned inward with respect to the end portion 92*c* along the axis direction Y2, the light irradiated from the first halogen lamp 12 may not be reflected to the heating roller 42 relatively when compared to in the opposite end portions located inward with respect to the end portion 92*c* along the axis direction Y2. Thus, in the overlapping heated region D, the reflectivity of light reflected to the heating roller 42 after being irradiated from the second halogen lamp 12 may be adjusted.

With the fixing unit 40B according to an embodiment, the light applied from the first halogen lamp 11 may be shielded by the first light-shielding unit 91, such that the light may not be reflected to the opposite end portions of the heating roller 42. Thus, the light irradiated from the first halogen lamp 11 may not be reflected to the opposite end portions relatively when compared to the center portion of the heating roller 42. Thus, in the first heated region, a larger amount of heat may be applied to the center portion than to the opposite end portions of the heating roller 42. On the other hand, the light irradiated from the second halogen lamp 12 may be shielded by the second light-shielding unit 92 such that the light is not reflected toward the center portion of the heating roller 42. Thus, the light irradiated from the second halogen lamp 12 may not be reflected to the center portion relatively when compared to the opposite end portions of the heating roller 42. Thus, in the second heated region, a larger amount of heat may be applied to the opposite end portions than to the center portion of the heating roller 42. Therefore, the heated region of the heating roller 42 may correspond relatively to paper P having different sizes.

A portion of the first halogen lamp 11 facing the heating roller 42 is covered by the first light-shielding unit 91. As a result, the light reflected by the first light-shielding unit 61B may be blocked and the light directly irradiated from the first halogen lamp 11 may also be shielded without being incident to the opposite end portions of the heating roller 42. On the other hand, a portion of the second halogen lamp 12 facing the heating roller 42 is covered by the second light-shielding unit 92. Thus, in the first heated region, a larger amount of heat may be applied to the center portion than to the opposite end portions of the heating roller 42. As a result, the light reflected by the second-second reflection unit 71B may be blocked and the light directly irradiated from the second halogen lamp 12 may also be shielded without being incident to the center portion of the heating roller 42. Thus, in the second heated region, a larger amount of heat may be applied to the opposite end portions than to the center portion of the heating roller 42. Therefore, the heated region of the heating roller 42 may correspond relatively to paper P having different sizes.

In this case, according to an embodiment, in the opposite end portions located outward with respect to the end portion 91*c* of the first light-shielding unit 91 along the axis direction Y1, the light irradiated from the first halogen lamp 11 may not be reflected to the heating roller 42, and in the center portion located inward with respect to the end portion 92*c* of the second light-shielding unit 92 along the axis direction Y2, the light irradiated from the second halogen lamp 12 may not be reflected to the heating roller 42. As such, because the end portions 91*c* and 92*c* of the first light-shielding unit 91 and the second light-shielding unit 92 that switch reflectivity are arranged in the overlapping heated region D, the reflectivity of light reflected to the heating roller 42 may be adjusted in the overlapping heated region D and thus an amount of heat applied to the heating roller 42 may be adjusted uniformly in the combined heated region combining the first heated region and the second heated region. As a result, the combined heated region of the heating roller 42 corresponds to the wide-width paper P, and thus the wide-width paper P may be heated uniformly along the widthwise direction thereof.

A fixing unit (fixing device) according to an embodiment of the present disclosure will be described with reference to FIG. 11. Although not shown in FIG. 11, the fixing unit 40 according to an embodiment of the present disclosure may include the heating roller 42, the first halogen lamp 11, the second halogen lamp 12, and the pressing roller 44. The fixing unit may include a first-third reflection member 60C and a second-third reflection member 70C, instead of the first reflection member 60 and the second reflection member 70.

Figure 11:
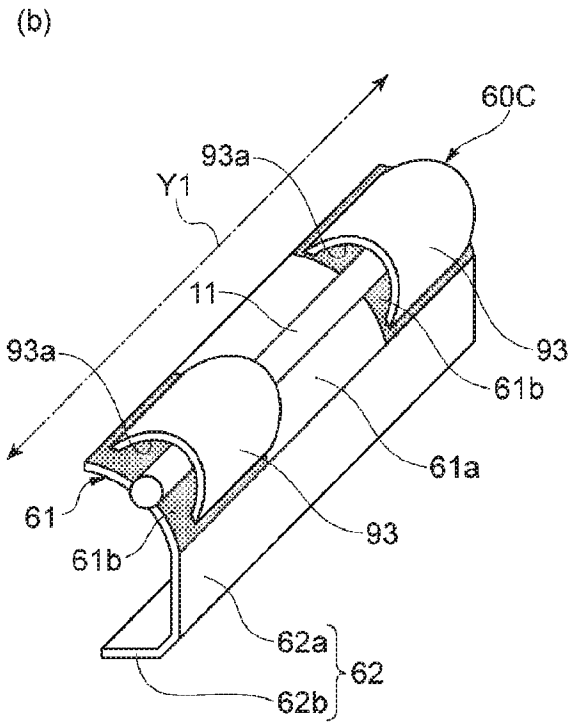
FIG. 11 illustrates perspective views of a reflection member according to an embodiment of the present disclosure.
Figure 11:
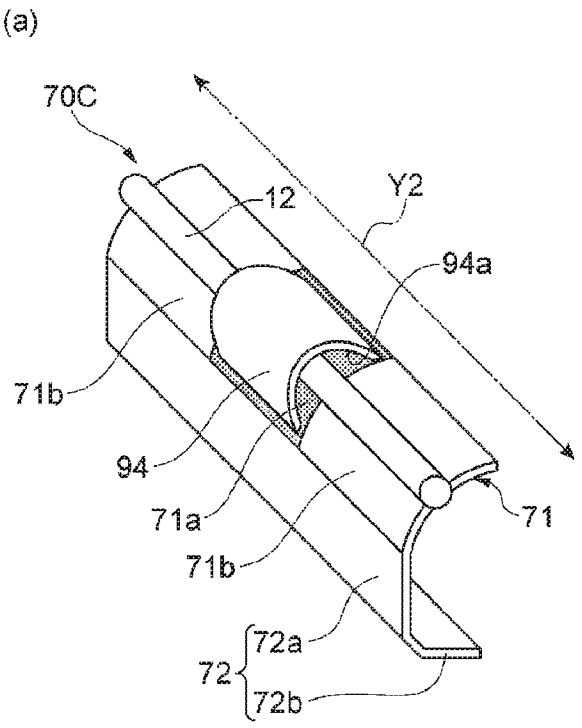

FIG. 11 illustrates perspective views of the first-third reflection member 60C and the second-third reflection member 70C according to an embodiment of the present disclosure. FIG. 11 corresponds to FIG. 4. As shown in (b) of FIG. 11, the first-third reflection member 60C (the first reflection member) according to an embodiment may include the first reflection unit 61 and the first heat transfer unit 62. A first-first light-shielding unit 93 may be arranged in opposite end portions of the first-third reflection member 60C positioned along the axis direction Y1 in the first-third reflection member 60C according to an embodiment of the present disclosure. In this case, the first halogen lamp 11 may be interposed between the first-first light shielding unit 93 and the first reflection unit 61. The first-first light-shielding unit 93 is arranged on a first end-portion surface 61*b* of the first reflection unit 61. The first-first light-shielding unit 93 blocks the light irradiated from the first halogen lamp 11, such that the irradiated light may not be reflected to the opposite end portions of the heating roller 42. The first-first light-shielding unit 93 has a dome shape and covers a part of the first halogen lamp 11 facing the heating roller 42. The first-first light-shielding unit 93 blocks the light reflected by the first reflection unit 61, and also blocks incidence of the light directly irradiated from the first halogen lamp 11 to the opposite end portions of the heating roller 42.

An inner surface 93*a* of the first-first light-shielding unit 93 facing the first halogen lamp 11 may have a lower reflectivity than a first center portion surface 61*a* of the first reflection unit 61. That is, the inner surface 93*a* of the first-first light-shielding unit 93 may be surface-treated to have a lower reflectivity than the first center-portion surface 61*a* of the first reflection unit 61. For example, the first center-portion surface 61*a* of the first reflection unit 61 may have a mirror surface by undergoing a mirror-surface treatment, whereas the inner surface 93*a* of the first-first light-shielding unit 93 may be blackened by plating or may have irregularities thereon by undergoing a rough-surface treatment. As stated before above, the reflectivity of the inner surface 93*a* of the first-first light-shielding unit 93 is low, such that the first-first light-shielding unit 93 reflects a less of the light irradiated from the first halogen lamp 11 and is heated by absorbing some of the irradiated light. Heat generated by the light absorbed by the first-first light-shielding unit 93 is delivered to the heating roller 42 through the first reflection unit 61 and the first heat transfer unit 62.

As shown in (a) of FIG. 11, the second-third reflection member 70C according to an embodiment may include the second reflection unit 71 and the second transfer unit 72. In opposite end portions of the second-third reflection member 70C according to an embodiment of the present disclosure, a second-first light-shielding unit 94 may be arranged. In this case, the second halogen lamp 12 may be interposed between the second-first light shielding unit 94 and the first reflection unit 71. The second-first light-shielding unit 94 arranged on a second center-portion surface 71*a* of the second reflection unit 71 blocks reflection of the light irradiated from the second halogen lamp 12 to the center portion of the heating roller 42. The second-first light-shielding unit 94 has a dome shape and covers a part of the second halogen lamp 12 facing the heating roller 42. The second-first light-shielding unit 94 blocks the light reflected by the second reflection unit 71, and also blocks incidence of the light directly irradiated from the second halogen lamp 12 to the center portion of the heating roller 42.

An inner surface 94*a* of the second-first light-shielding unit 94 facing the second halogen lamp 12 may have a lower reflectivity than a second end portion surface 71*b* of the second reflection unit 71. For example, the inner surface 94*a* of the second-first light-shielding unit 94 may be surface-treated to have a lower reflectivity than the second end portion surface 71*b* of the first reflection unit 61. For example, the second end portion surface 71*b* of the first reflection unit 61 may have a mirror surface by undergoing a mirror-surface treatment, whereas the inner surface 94*a* of the second-first light-shielding unit 94 may be blackened by plating or may have irregularities thereon by undergoing a rough-surface treatment. As stated before, the reflectivity of the inner surface 94*a* of the second-first light-shielding unit 94 is low, such that the second-first light-shielding unit 94 may be heated by absorbing some of the light irradiated from the second halogen lamp 12 without reflecting the irradiated light. Heat generated by the light absorbed by the second-first light-shielding unit 94 is delivered to the heating roller 42 through the second reflection unit 71 and the second heat transfer unit 72.

As described above, according to an embodiment of the present disclosure, the first-first light-shielding unit 93 is further included in the first reflection unit 61, such that in the first heated region, the center portion of the heating roller 42 may be heated further than the opposite end portions of the heating roller 42. Moreover, the second-first light-shielding unit 94 is further included in the second reflection unit 71, such that in the second heated region, the opposite end portions of the heating roller 42 may be heated further than the center portion of the heating roller 42. Therefore, the heated region of the heating roller 42 may correspond relatively to paper P having different sizes.

According to an embodiment of the present disclosure, the inner surface 93*a* of the first-first light-shielding unit 93 has a lower reflectivity than the first center-portion surface 61*a*, such that the inner surface 93*a* may absorb a more of the light irradiated from the first halogen lamp 11, thus being more easily heated, than the first center-portion surface 61*a*. The inner surface 94*a* of the second-first light-shielding unit 94 has a lower reflectivity than the second end-portion surface 71*b*, such that inner surface 94*a* may absorb a more of the light irradiated from the second halogen lamp 12, thus being more easily heated, than the second-end portion surface 71*b*. Consequently, the third and fourth light-shielding units 93 and 94 block the light irradiated from the first halogen lamp 11 and the second halogen lamp 12, respectively, and generate heat by absorbing the blocked light and transfer the generated heat to the first reflection unit 61 and the second reflection unit 71, further improving heat efficiency.

A fixing unit (fixing device) according to an embodiment of the present disclosure will be described with reference to FIG. 12. The fixing unit according to an embodiment of the present disclosure may include the heating roller 42, the first halogen lamp 11, the second halogen lamp 12, and the pressing roller 44 like the fixing unit 40B according to an embodiment of the present disclosure. The fixing unit according to an embodiment of the present disclosure may include a first-fourth reflection plate 60D and a second-fourth reflection plate 70D shown in FIG. 12, instead of the first-second reflection member 60B and the second-second reflection member 70B.

Figure 12:
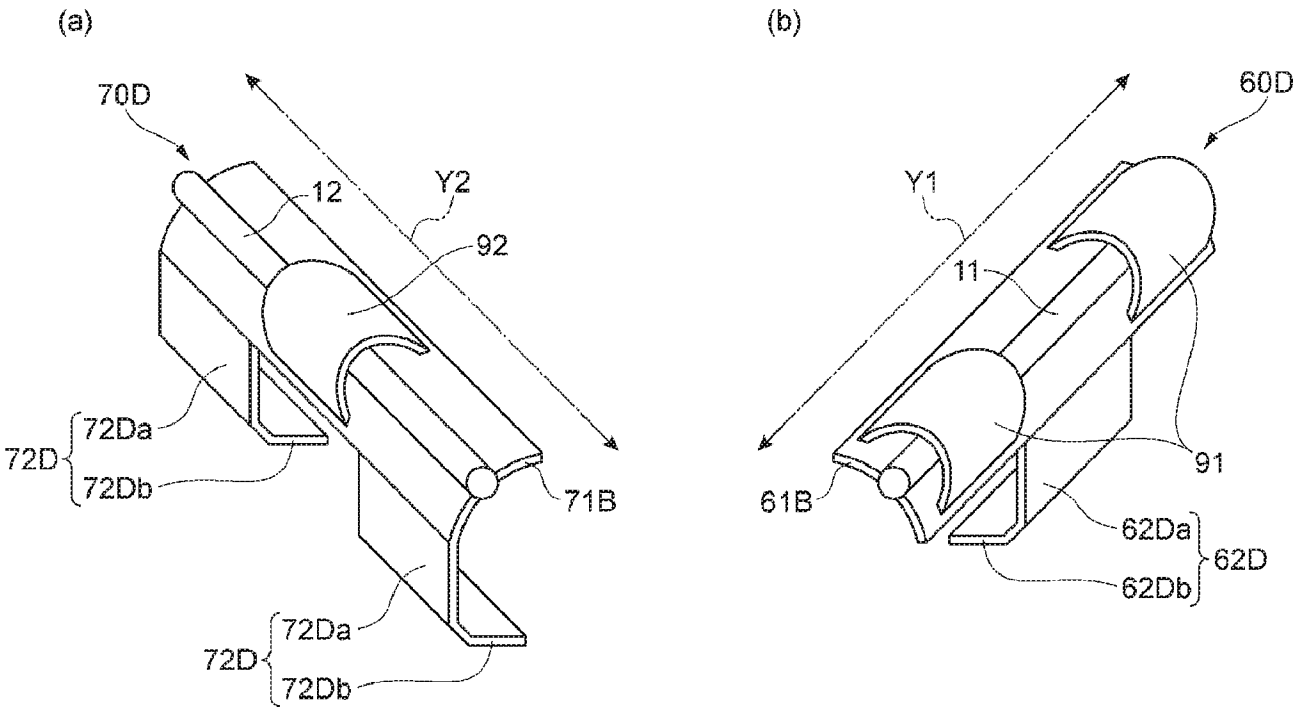
FIG. 12 illustrates perspective views of a reflection member according to an embodiment of the present disclosure.

FIG. 12 illustrates perspective views of the first-fourth reflection plate 60D and the second-fourth reflection plate 70D, according to an embodiment of the present disclosure. FIG. 12 corresponds to FIG. 10. As shown in (b) of FIG. 12, the first-fourth reflection plate 60D is different from the first-second reflection member 60B in that the first-fourth reflection pate 60D has a first-first heat transfer unit 62D instead of the first heat transfer unit 62. The first-first heat transfer unit 62D may be formed such that the opposite end portions positioned along the axis direction Y1 are cut away. That is, the first-first heat transfer unit 62D may be arranged in the center portion along the axis direction Y1, but the opposite end portions of the first-first heat transfer unit 62D along the axis direction Y1 may not be present. The first-first heat transfer unit 62D may have a smaller width than the first-second reflection unit 61B along the axis direction Y1.

The first-first heat transfer unit 62D may include a longitudinal portion 62Da extending from the first-second reflection unit 61B to the heating roller 42 and a transverse portion 62Db contacting an inner surface of the heating roller 42. For example, the longitudinal portion 62Da may extend along a direction intersecting the inner surface of the heating roller 42, and the transverse portion 62Db may extend along the inner surface of the heating roller 42. The longitudinal portion 62Da may transfer heat generated by light absorbed by the first-second reflection unit 61B to the transverse portion 62Db arranged to contact the inner surface of the heating roller 42.

The transverse portion 62Db may extend approximately in parallel with the inner surface of the heating roller 42. The transverse portion 62Db may extend to the nip portion N of the inner surface of the heating roller 42. The transverse portion 62Db transfers the heat delivered from the longitudinal portion 62Da to the heating roller 42. Thus, heat generated by light that is not reflected to the heating roller 42 from among the light irradiated to the first-second reflection unit 61B from the first halogen lamp 11 (hereinafter, referred to as 'first absorbed heat' by the first-second reflection unit 61B) may be transferred to the nip portion N positioned in the center portion of the heating roller 42.

As shown in (a) of FIG. 12, the second-fourth reflection plate 70D may include a second-first heat transfer unit 72D. The second-first heat transfer unit 72D may be formed such that the center portion along the axis direction Y2 is cut away. That is, the second-first heat transfer unit 72D may be arranged to include the opposite end portions along the axis direction Y2, but the center portion along the axis direction Y2 may not be included. For example, the second-first heat transfer unit 72D may have a narrower width than the second-second reflection unit 71B along the axis direction Y2.

The second-first heat transfer unit 72D may include a longitudinal portion 72Da extending from the second-second reflection unit 71B to the heating roller 42 and a transverse portion 72Db contacting an inner surface of the heating roller 42. The longitudinal portion 72Da may extend along a direction intersecting the inner surface of the heating roller 42, and the transverse portion 72Db may extend along the inner surface of the heating roller 42. The longitudinal portion 72Da may transfer heat generated by being absorbed by the second-second reflection unit 71B to the transverse portion 72Db of the heating roller 42.

The transverse portion 72Db may extend approximately in parallel with the inner surface of the heating roller 42, and in this case, the transverse portion 72Db may extend to the nip portion N on the inner surface of the heating roller 42. The transverse portion 72Db transfers the heat delivered from the longitudinal portion 72Da to the opposite end portions of the heating roller 42. Thus, heat generated by light that is not reflected to the heating roller 42 from among the light irradiated to the second-second reflection unit 71B from the second halogen lamp 12 (hereinafter, referred to as 'second absorbed heat' by the second-second reflection unit 71B) may be transferred to the nip portion N arranged in the opposite end portions of the heating roller 42.

In an embodiment of the present disclosure, a side in which the first-fourth reflection plate 60D is open and a side in which the second-fourth reflection plate 70D is open are spaced apart from each other by the virtual line X, and in this case, the first-fourth reflection plate 60D and the second-fourth reflection plate 70D may not face each other. If the first-second reflection unit 61B and the second-second reflection unit 71B are arranged in a non-contact manner, the first-fourth reflection plate 60D may be mounted in the inside of the side where the second-fourth reflection plate 70D is open. For example, the first-fourth reflection plate 60D and the second-fourth reflection plate 70D may be arranged such that the first-first heat transfer unit 62D of the first-fourth reflection plate 60D is interposed between the second-first heat transfer units 72D positioned in the opposite end portions of the second-fourth reflection plate 70D. That is, the first-first heat transfer unit 62D located in the center portion may be arranged between the second-first heat transfer units 72D arranged in the opposite end portions along the axis direction Y2.

With respect to the fixing unit according to an embodiment, the first absorbed heat by the first-second reflection unit 61B may be easily transferred to the center portion of the heating roller 42 by the first-first heat transfer unit 62D. Thus, in the first heated region, a larger amount of heat may be applied to the center portion than to the opposite end portions of the heating roller 42. On the other hand, the second absorbed heat by the second-second reflection unit 71B may be more easily transferred to the opposite end portions of the heating roller 42 by the second-first heat transfer unit 72D. Thus, in the second heated region, a larger amount of heat may be applied to the opposite end portions than to the center portion of the heating roller 42. Therefore, the heated region of the heating roller 42 may correspond relatively to paper P having different sizes.

Figure 13:
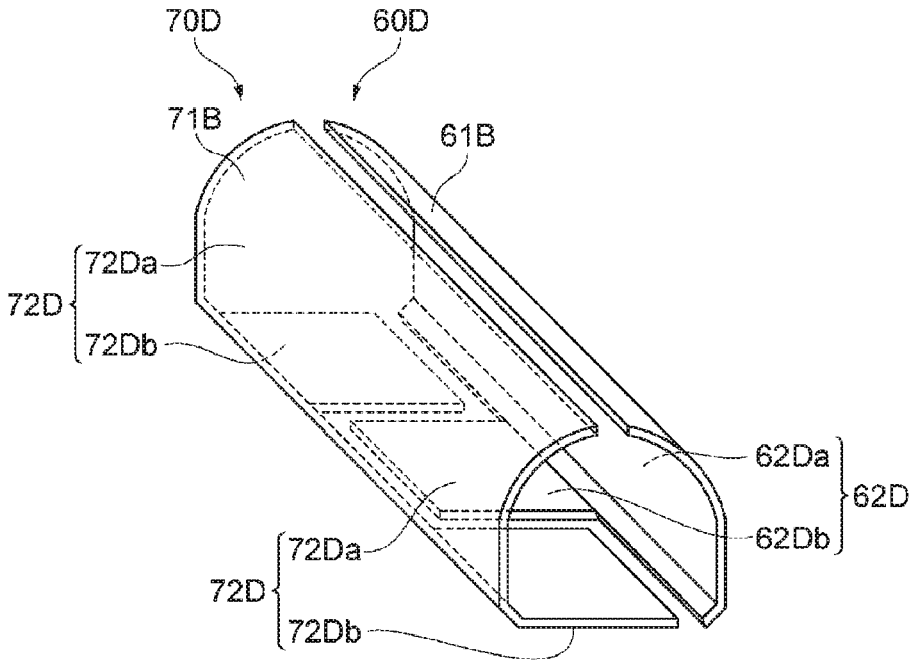
FIG. 13 is a perspective view of a heat transfer unit according to a modified example.

The third heat transfer unit 62D and the fourth heat transfer unit 72D may be formed such that the whole portions thereof including the longitudinal portions 62Da and 72Da and the transverse portions 62Db and 72Db are cut away like in an embodiment, but embodiments are not limited thereto and at least some parts thereof may be cut away. More specifically, the third heat transfer unit 62D and the fourth heat transfer unit 72D according to a modified example will be described with reference to FIG. 13. As shown in FIG. 13, the transverse portion 62Db included in the first-first heat transfer unit 62D according to an embodiment may be formed such that opposite end portions along the axis direction Y1 are cut away. Also, the transverse portion 72Db included in the second-first heat transfer unit 72D may be formed such that the center portion along the axis direction Y2 is cut away.

In a modified example, the longitudinal portion 62Da may be arranged in the center portion and the opposite end portions along the axis direction Y1 and may be formed to have substantially the same width as the first-second reflection unit 61B along the axis direction Y1. The transverse portion 62Db may be arranged in the center portion along the axis direction Y1, and in this case, may not be arranged in the opposite end portions along the axis direction Y1. That is, the transverse portion 62Db may have a smaller width than the first-second reflection unit 61B along the axis direction Y1.

The longitudinal portion 72Da may be arranged in the center portion and the opposite end portions along the axis direction Y2 and may be formed to have substantially the same width as the second-second reflection unit 71B along the axis direction Y2. The transverse portion 72Db may be arranged in the opposite end portions along the axis direction Y2, and in this case, may not be arranged in the center portion along the axis direction Y2. That is, the transverse portion 72Db may have a smaller width than the second-second reflection unit 71B along the axis direction Y2.

That is, the transverse portion 62Db positioned in the center portion may be arranged between the transverse portions 72Db positioned in the opposite end portions along the axis direction Y2. That is, the transverse portion 62Db may be inserted between the transverse portions 72Db. In an modified example, the first absorbed heat by the first-second reflection unit 61B may be transferred to the center portion of the heating roller 42 by the transverse portion 62Db without being transferred to the opposite end portions of the heating roller 42. Thus, in the first heated region, a larger amount of heat may be applied to the center portion than to the opposite end portions of the heating roller 42. On the other hand, the second absorbed heat by the second-second reflection unit 71B may be transferred to the opposite end portions of the heating roller 42 by the transverse portion 72Db without being transferred to the center portion of the heating roller 42. Thus, in the second heated region, a larger amount of heat may be applied to the opposite end portions than to the center portion of the heating roller 42. Therefore, the heated region of the heating roller 42 may correspond relatively to paper P having different sizes. Moreover, the transverse portion 62Db in the center portion along the axis direction Y1 is arranged between the transverse portions 72Db in the opposite end portions along the axis direction Y2, such that the nip portion N formed along the axis directions Y1 and Y2 may have less irregularities thereon.

Figure 14:
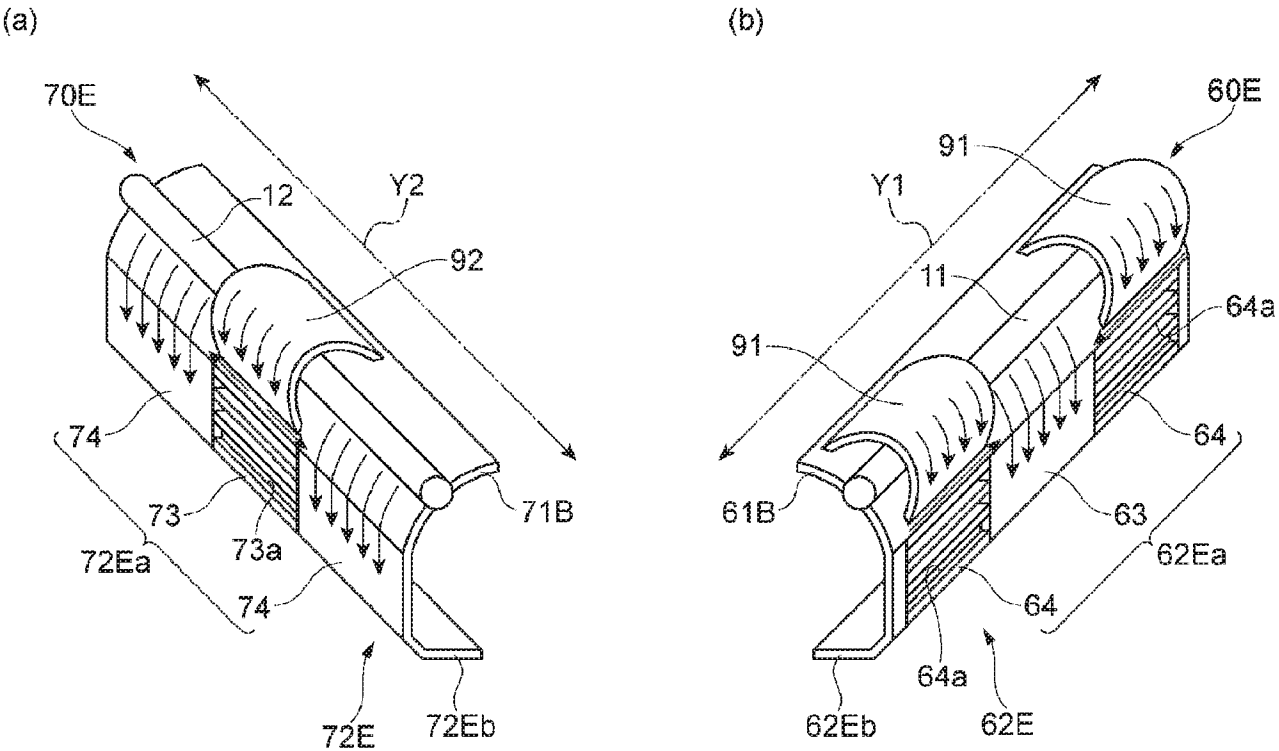
FIG. 14 illustrates perspective views of a reflection member according to an embodiment of the present disclosure.

A fixing unit (fixing device) according to an embodiment of the present disclosure will be described with reference to FIG. 14. The fixing unit according to an embodiment of the present disclosure may include the heating roller 42, the first halogen lamp 11, the second halogen lamp 12, and the pressing roller 44, though being not shown. The fixing unit according to an embodiment of the present disclosure may include a first-fifth reflection plate 60E and a second-fifth reflection plate 70E shown in FIG. 14, instead of the first-second reflection member 60B and the second-second reflection member 70B. FIG. 14 illustrates perspective views of the first-fifth reflection plate 60E and the second-fifth reflection plate 70E, according to an embodiment of the present disclosure. A solid arrow shown in FIG. 14 indicates heat transferred through the first-fifth reflection plate 60E and the second-fifth reflection plate 70E.

As shown in (b) of FIG. 14, the first-fifth reflection plate 60E may include a first-second heat transfer unit 62E instead of the first heat transfer unit 62. The first-second heat transfer unit 62E may include a longitudinal portion 62Ea extending from the first reflection unit 61 to the heating roller 42 and a transverse portion 62Eb contacting an inner surface of the heating roller 42. The longitudinal portion 62Ea may extend along a direction intersecting the inner surface of the heating roller 42, and the transverse portion 62Eb may extend along the inner surface of the heating roller 42. The longitudinal portion 62Ea may transfer heat generated by light absorbed by the first-second reflection unit 61B to the transverse portion 62Eb.

The longitudinal portion 62Ea may include a first center heat transfer unit 63 arranged in the center portion along the axis direction Y1 and a first end heat transfer unit 64 arranged in the opposite end portions along the axis direction Y1. The first end heat transfer unit 64 may have a lower conductivity than the first center heat transfer unit 63. For example, a through-hole 64*a* may be formed in the first end heat transfer unit 64, such that the first end heat transfer unit 64 may transfer heat more difficultly than the first center heat transfer unit 63. That is, the longitudinal portion 62Ea may more easily transfer heat to the center portion of the heating roller 42 than to the opposite end portions of the heating roller 42. The through-hole 64*a* according to an embodiment may have a slit structure extending along the axis direction Y1 as shown in FIG. 14, and may also have an opening shape having various forms including a long hole, a circular hole, or the like.

The longitudinal portion 62Eb may extend approximately in parallel with the inner surface of the heating roller 42, and in this case, the transverse portion 62Eb according to an embodiment may extend to the nip portion N on the inner surface of the heating roller 42. The transverse portion 62Eb transfers the heat delivered from the longitudinal portion 62Ea to the heating roller 42. Thus, heat generated by light that is not reflected to the heating roller 42 from among the light irradiated to the first-second reflection unit 61B from the first halogen lamp 11 (hereinafter, referred to as 'first absorbed heat' by the first-second reflection unit 61B) may be transferred to the nip portion N. A through-hole may also be formed in opposite end portions of the transverse portion 62Eb. The opposite end portions of the transverse portion 62Eb may have lower conductivity than the center portion of the transverse portion 62Eb.

As shown in (a) of FIG. 14, the second-fifth reflection plate 70E may include a second-second heat transfer unit 72E instead of the second heat transfer unit 72. The second-second heat transfer unit 72E may include a longitudinal portion 72Ea extending from the second-second reflection unit 71B to the heating roller 42 and a transverse portion 72Eb contacting an inner surface of the heating roller 42. The longitudinal portion 72Ea may extend along a direction intersecting the inner surface of the heating roller 42, and the transverse portion 72Eb may extend along the inner surface of the heating roller 42. The longitudinal portion 72Ea may transfer heat generated by being absorbed by the second-second reflection unit 71B to the transverse portion 72Eb of the heating roller 42.

The longitudinal portion 72Ea may include a second center heat transfer unit 73 arranged in the center portion along the axis direction Y2 and a second end heat transfer unit 74 arranged in the opposite end portions along the axis direction Y2. The second center heat transfer unit 73 may have a lower conductivity than the second end heat transfer unit 74. For example, a through-hole 73*a* may be formed in the second center heat transfer unit 73, such that the second center heat transfer unit 73 may transfer heat more difficultly than the second end heat transfer unit 74. That is, the longitudinal portion 72Ea may more easily transfer heat to the opposite end portions of the heating roller 42 than to the center portion of the heating roller 42. The through-hole 73*a* may have a slit structure extending along the axis direction Y2 as shown in FIG. 14, and may also have an opening shape having various forms including a long hole, a circular hole, or the like.

The transverse portion 72Eb may extend approximately in parallel with the inner surface of the heating roller 42. The transverse portion 72Eb may extend to the nip portion N of the inner surface of the heating roller 42. The transverse portion 72Eb transfers the heat delivered from the longitudinal portion 72Ea to the heating roller 42. Thus, heat generated by light that is not reflected to the heating roller 42 from among the light irradiated to the second-second reflection unit 71B from the second halogen lamp 12 (hereinafter, referred to as 'second absorbed heat' by the second-second reflection unit 71B) may be transferred to the nip portion N. A through-hole may also be formed in the center portion of the transverse portion 72Eb. That is, the center portion of the transverse portion 72Eb may have a lower conductivity than the end portion of the transverse portion 72Eb.

With the fixing unit according to an embodiment, the first absorbed heat by the first-second reflection unit 61B is transferred to the center portion of the heating roller 42 by the first center heat transfer unit 63, and at the same time, is delivered to the opposite end portions of the heating roller 42 by the first end heat transfer unit 64. Because the first end heat transfer unit 64 has a lower conductivity than the first center heat transfer unit 63, heat may be more easily transferred to the center portion of the heating roller 42 than to the opposite end portions of the heating roller 42. Thus, in the first heated region, a larger amount of heat may be applied to the center portion than to the opposite end portions of the heating roller 42. The second absorbed heat by the second-second reflection unit 71B is transferred to the center portion of the heating roller 42 by the second heat transfer unit 73, and is delivered to the opposite end portions of the heating roller 42 by the second end heat transfer unit 74. Because the second center heat transfer unit 73 has a lower conductivity than the second end heat transfer unit 74, heat may be more easily transferred to the opposite end portions of the heating roller 42 than to the center portion of the heating roller 42. Thus, in the second heated region, a larger amount of heat may be applied to the opposite end portions than to the center portion of the heating roller 42. As a result, the heated region of the heating roller 42 may correspond relatively to paper P having different sizes.

According to an embodiment, the through-hole 64*a* is formed in the first-end heat transfer unit 64, thus more easily lowering the heat transfer rate of the first end heat transfer unit 64 than the heat transfer rate of the first center heat transfer unit 63. Thus, in the first heated region, a larger amount of heat may be applied to the center portion than to the opposite end portions of the heating roller 42. Moreover, the through-hole 73*a* is formed in the second center heat transfer unit 73, thus more easily lowering the heat transfer rate of the second center heat transfer unit 73 than the heat transfer rate of the second end heat transfer unit 74. Thus, in the second heated region, a larger amount of heat may be applied to the opposite end portions than to the center portion of the heating roller 42. As a result, the heated region of the heating roller 42 may correspond relatively to paper P having different sizes.

In addition, the through-hole 64*a* formed in the first end heat transfer unit 64 has a slit form extending along the axis direction Y1 intersecting the heat transfer direction, and the through-hole 73*a* formed in the second center heat transfer unit 73 may have a slit form extending along the axis direction Y2 intersecting the heat transfer direction. In this case, heat conductivities of portions where the through-holes 64*a* and 73*a* are formed may be effectively lowered, such that the heated region of the heating roller 42 may more appropriately correspond relatively to recording media having different sizes.

Figure 15:
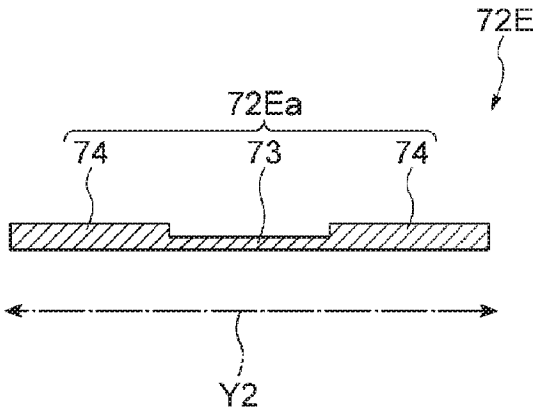
FIG. 15 illustrates cross-sectional views of a contact portion according to a modified example.
Figure 15:
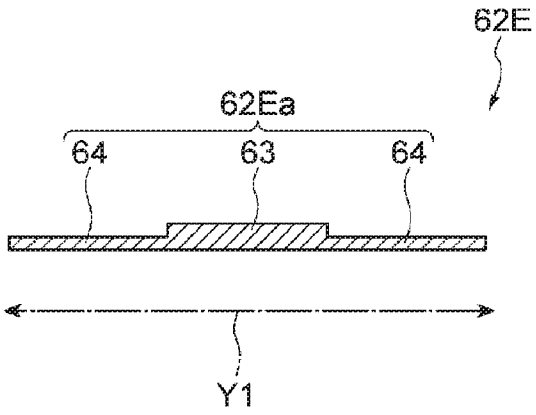

Although the first end heat transfer unit 64 is structured to have a lower heat conductivity than the first center heat transfer unit 63 and the through-hole 64*a* is formed in the first end heat transfer unit 64 in the first-second heat transfer unit 62E in an embodiment of the present disclosure, the present disclosure is not limited to this example. In addition, although the second center heat transfer unit 73 is structured to have a lower heat conductivity than the second end heat transfer unit 74 and the through-hole 73*a* is formed in the second center heat transfer unit 73 in the second-second heat transfer unit 72E in an embodiment of the present disclosure, the present disclosure is not limited to this example. Referring to FIG. 15, a fifth heat transfer unit 62E and a sixth heat transfer unit 72E according to a modified example will be described. FIG. 15 illustrates schematic cross-sectional views of the fifth heat transfer unit 62E and the sixth heat transfer unit 72E, according to a modified example. (a) of FIG. 15 shows a cross-section cut along a line a-a of (a) of FIG. 10, and (b) of FIG. 15 shows a cross-section cut along a line b-b of (b) of FIG. 10. For the sake of description, the axis direction Y2 of the second halogen lamp 12 is indicated by a dashed dotted arrow in (a) of FIG. 15, and the axis direction Y1 of the first halogen lamp 11 is indicated by a dashed dotted arrow in (b) of FIG. 15.

As shown in (b) of FIG. 15, the first-second heat transfer unit 62E according to a modified example may be formed such that the first end heat transfer unit 64 has a lower heat conductivity than the first center heat transfer unit 63, and in this case, the first end heat transfer unit 64 may be thinner than the first center heat transfer unit 63. That is, a thickness of the first end heat transfer unit 64 along a direction orthogonal to the axis direction Y1 is smaller than a thickness of the first center heat transfer unit 63 along the direction orthogonal to the axis direction Y1. In addition, as shown in (a) of FIG. 13, the second-second heat transfer unit 72E according to a modified example may be formed such that the second center heat transfer unit 73 has a lower heat conductivity than the second end heat transfer unit 74, and in this case, the second center heat transfer unit 73 may be thinner than the second end heat transfer unit 74. That is, a thickness of the second end heat transfer unit 73 along the direction orthogonal to the axis direction Y2 is smaller than a thickness of the second end heat transfer unit 74 along the direction orthogonal to the axis direction Y2.

According to the modified example, the first end heat transfer unit 64 is thinner than the first center heat transfer unit 63, thus more easily lowering the heat transfer rate of the first end heat transfer unit 64 than the heat transfer rate of the first center heat transfer unit 63. The second center heat transfer unit 73 is thinner than the second end heat transfer unit 74, thus more easily lowering the heat transfer rate of the second center heat transfer unit 73 than the heat transfer rate of the second end heat transfer unit 74. Therefore, the heated region of the heating roller 42 may correspond relatively to recording media having different sizes.

The first through fourth light-shielding units 91 through 94 may not be formed in a dome shape. That is, the first light-shielding unit 91 and the third light-shielding unit 93 may not cover the first halogen lamp 11, and the second light-shielding unit 92 and the fourth light-shielding unit 94 may not cover the second halogen lamp 12. The inner surface 93*a* of the first-first light-shielding unit 93 may not have a lower reflectivity than the first center-portion surface 61*a*, and the inner surface 94*a* of the second-first light-shielding unit 94 may not have a lower reflectivity than the second end-portion surface 71*b*.

Figure 16:
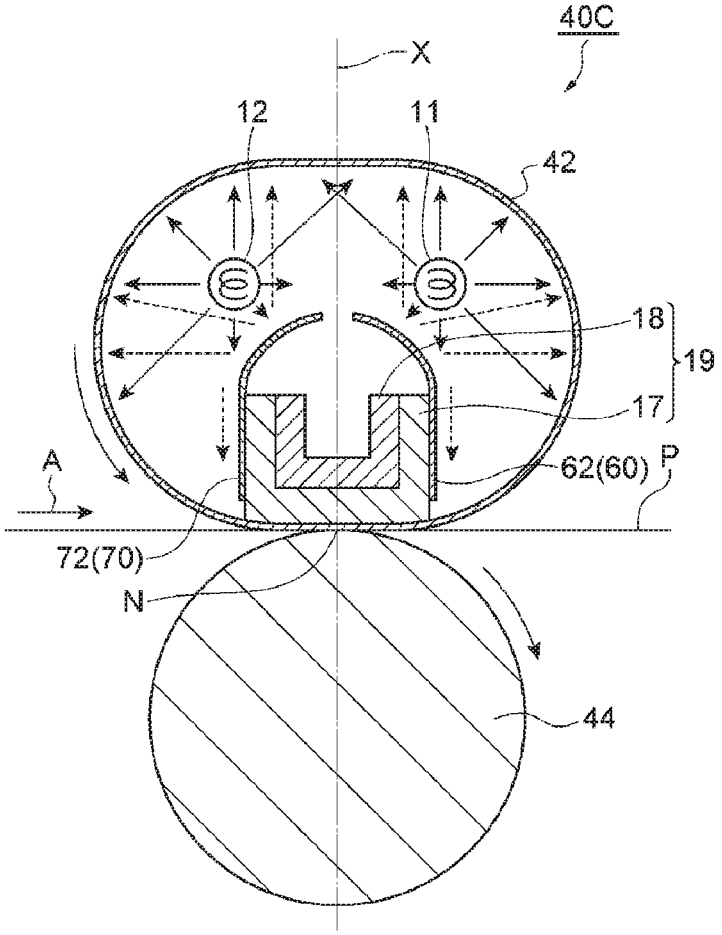
FIG. 16 is a cross-sectional view of a fixing device according to a modified example.

In the fixing unit 40C according to a modified example shown in FIG. 16, the pressing portion 19 contacts the heating roller 42, and the first heat transfer unit 62 and the second heat transfer unit 72 transfer heat to the heating roller 42 by using the pressing portion 19. In this case, a portion contacting the pressing roller 42 may not be installed in the first heat transfer unit 62 and the second heat transfer unit 72.

Figure 17:
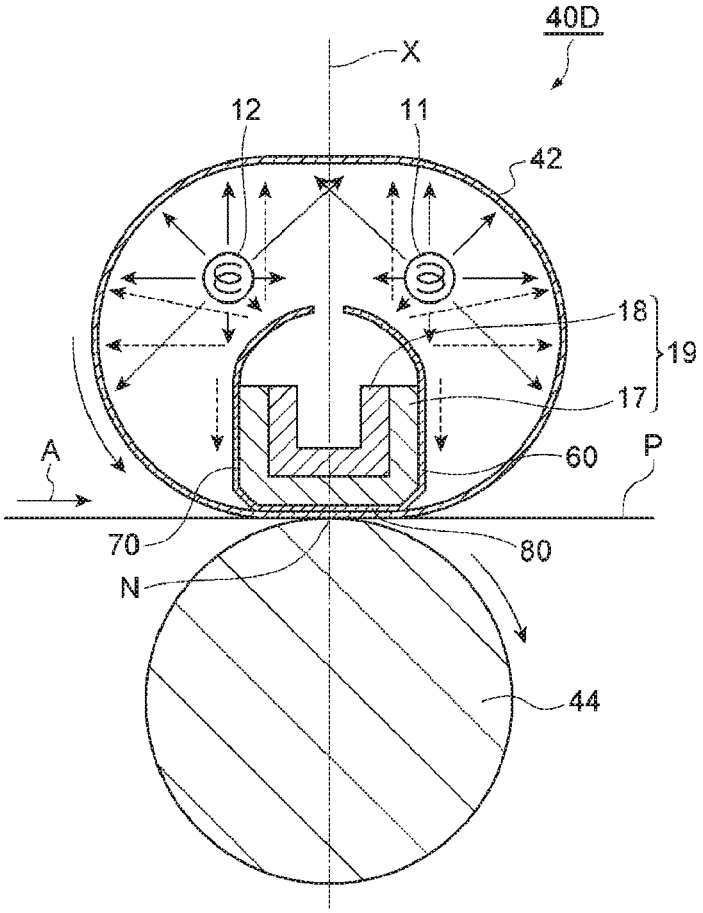
FIG. 17 is a cross-sectional view of a fixing device according to a modified example.

Although the transverse portion 62*b* and the transverse portion 72*b* are arranged in non-contact with each other, the present disclosure is not limited to this example. The transverse portion 62*b* and the transverse portion 72*b* may be arranged in a non-contact manner or may be integrated into one piece. For example, in the fixing unit 40D according to a modified example shown in FIG. 17, the first reflection member 60 and the second reflection member 70 may share one transverse portion 80 contacting the inner surface of the heating roller 42. That is, the first reflection member 60 and the second reflection member 70 may not be independent of each other.

While various embodiments of the present disclosure have been described, the present disclosure may be modified or applied differently within a range that does not change the subject matter disclosed in the claims, without being limited to the above-described embodiments.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A fixing device comprising:

a rotatable heating rotator;

a pressing rotator configured to press-contact the heating rotator and to form a nip portion between the pressing rotator and the heating rotator;

a pressing portion configured to apply pressure to the heating rotator such that the heating rotator press-contacts the pressing rotator;

a first halogen lamp configured to extend along a rotation axis direction of the heating rotator and to heat the heating rotator;

a second halogen lamp configured to extend along the rotation axis direction of the heating rotator in parallel with the first halogen lamp and to heat the heating rotator;

a first reflection member configured to extend along a first axis substantially parallel to the first halogen lamp and including a first reflection unit configured to reflect light irradiated from the first halogen lamp to the heating rotator, the first reflection unit including a center portion having a higher reflectivity than opposite end portions of the first reflection unit; and a second reflection member configured to extend along a second axis substantially parallel to the second halogen lamp and including a second reflection unit configured to reflect light irradiated from the second halogen lamp to the heating rotator, the second reflection unit including opposite end portions having a higher reflectivity than a center portion of the second reflection unit.

2. The fixing device of claim 1, wherein the first reflection member further comprises a first heat transfer unit configured to extend from the first reflection unit and to transfer, to the heating rotator, heat generated by light not reflected by the first reflection unit from the light irradiated from the first halogen lamp, the second reflection member comprises a second heat transfer unit configured to extend from the second reflection unit and to transfer, to the heating rotator, heat generated by light not reflected by the second reflection unit from the light irradiated from the second halogen lamp, and the first heat transfer unit is separated from the second heat transfer unit.

3. The fixing device of claim 2, wherein the first heat transfer unit comprises a first contact portion configured to contact the heating rotator, the second heat transfer unit comprises a second contact portion configured to contact the heating rotator, and the pressing unit is configured to pressingly contact the heating rotator and the pressing rotator by applying pressure to the first contact portion and the second contact portion.

4. The fixing device of claim 3, wherein the first heat transfer unit and the second heat transfer unit are arranged in a non-contact manner.

5. The fixing device of claim 4, wherein the opposite end portions of the first contact unit are open, and the center portion of the second contact unit is open, and the first contact unit is arranged between the opposite end portions of the second contact unit arranged along the second axis direction.

6. The fixing device of claim 2, wherein the pressing unit is configured to contact the heating rotator, and the first heat transfer unit and the second heat transfer unit transfer heat to the heating rotator using the pressing unit as a heat transfer medium.

7. The fixing device of claim 3, wherein the opposite end portions of the first heat transfer unit are open, and the center portion of the second heat transfer unit is open.

8. The fixing device of claim 2, wherein the first heat transfer unit comprises a first center heat transfer unit located in the center portion along the first axis direction and a first end heat transfer unit, having a lower heat conductivity than the first center heat transfer unit, located in the opposite end portions along the first axis direction, and the second heat transfer unit comprises a second center heat transfer unit located in the center portion along the axis direction and a second end heat transfer unit, having a lower heat conductivity than the second end heat transfer unit, located in the opposite end portions along the axis direction.

9. The fixing device of claim 8, wherein a through-hole in a form of a slit is arranged in the first end heat transfer unit to extend along the first axis direction, and a through-hole in a form of a slit is arranged in the second center heat transfer unit to extend along the second axis direction.

10. The fixing device of claim 8, wherein the first end heat transfer unit is thinner than the first center heat transfer unit, and the second center heat transfer unit is thinner than the second end heat transfer unit.

11. The fixing device of claim 1, wherein the first halogen lamp includes a center-portion heating arrangement comprising a first heated region that contributes to heating of a center portion of the heating rotator, and the second halogen lamp includes an end-portion heating arrangement comprising a second heated region that contributes to heating of opposite end portions of the heating rotator.

12. The fixing device of claim 11, wherein the first heated region and the second heated region partially overlap each other along the first axis direction and the second axis direction, and a boundary between the center portion and the opposite end portions included in the first reflection unit and a boundary between the center portion and the opposite end portions included in the second reflection unit are located in the partial overlapping region.

13. The fixing device of claim 1, wherein the opposite end portions of the first reflection unit include a first end-portion surface having a lower reflectivity than a first center-portion surface located in the center portion of the first reflection unit, and the center portion of the second reflection unit includes a second center-portion surface having a lower reflectivity than a second end-portion surface located in the opposite end portions of the second reflection unit.

14. The fixing device of claim 1, wherein the opposite end portions of the first reflection unit are open, and the center portion of the second reflection unit is open.

15. A fixing device comprising:

a rotatable heating rotator;

a pressing rotator configured to pressingly contact with the heating rotator and to form a nip portion between the pressing rotator and the heating rotator;

a pressing portion configured to apply pressure to the heating rotator such that the heating rotator pressingly contacts with the pressing rotator;

a first halogen lamp configured to extend along a rotation axis direction of the heating rotator and to heat the heating rotator;

a second halogen lamp configured to extend along the rotation axis direction of the heating rotator in parallel with the first halogen lamp and to heat the heating rotator;

a first reflection member configured to extend along a first axis substantially parallel to the first halogen lamp and including a first reflection member configured to reflect light irradiated from the first halogen lamp to the heating rotator, the first reflection member including a first light-shielding unit arranged in opposite end portions of the first reflection member to prevent light irradiated from the first halogen lamp from being reflected to the heating rotator; and a second reflection member configured to extend along a second axis substantially parallel to the second halogen lamp and including a second reflection member configured to reflect light irradiated from the second halogen lamp to the heating rotator, the second reflection member including a second light-shielding unit arranged in a center portion of the second reflection member to prevent the light irradiated from the second halogen lamp from being reflected to the heating rotator.

16. The fixing device of claim 15, wherein the first halogen lamp includes a center-portion heating arrangement comprising a first heated region that contributes to heating of the center portion of the heating rotator, and the second halogen lamp includes an end-portion heating arrangement comprising a second heated region that contributes to heating of the opposite end portions of the heating rotator.

17. The fixing device of claim 16, wherein the first heated region and the second heated region partially overlap each other along the first axis direction and the second axis direction, and an inner end portion of the first light-shielding unit and an outer end portion of the second light-shielding unit are located in the partial overlapping region.

18. The fixing device of claim 15, wherein the first light-shielding unit covers the heating rotator of the first halogen lamp, and the second light-shielding unit covers the heating rotator of the second halogen lamp.

19. The fixing device of claim 18, wherein a surface of the first light-shielding unit arranged to face the first halogen lamp has a lower reflectivity than a first center-portion surface located in the center portion of the first reflection unit, and a surface of the second light-shielding unit arranged to face the second halogen lamp has a lower reflectivity than a second end-portion surface located in the opposite end portions of the second reflection unit.

20. An image forming apparatus comprising:

a fixing device comprising:

a rotatable heating rotator;

a pressing rotator configured to press-contact the heating rotator and to form a nip portion between the pressing rotator and the heating rotator;

a pressing portion configured to apply pressure to the heating rotator such that the heating rotator press-contacts the pressing rotator;

a first halogen lamp configured to extend along a rotation axis direction of the heating rotator and to heat the heating rotator;

a second halogen lamp configured to extend along the rotation axis direction of the heating rotator in parallel with the first halogen lamp and to heat the heating rotator;

a first reflection member configured to extend along a first axis substantially parallel to the first halogen lamp and including a first reflection unit configured to reflect light irradiated from the first halogen lamp to the heating rotator, the first reflection unit including a center portion having a higher reflectivity than opposite end portions of the first reflection unit; and a second reflection member configured to extend along a second axis substantially parallel to the second halogen lamp and including a second reflection unit configured to reflect light irradiated from the second halogen lamp to the heating rotator, the second reflection unit including opposite end portions having a higher reflectivity than a center portion of the second reflection unit.

* * * * *